US008167158B2

(12) United States Patent
Yamauchi

(10) Patent No.: US 8,167,158 B2
(45) Date of Patent: May 1, 2012

(54) FOLDING CONTAINER

(75) Inventor: Hisatoshi Yamauchi, Mizuho (JP)

(73) Assignee: Sanko Co., Ltd., Mizuho-shi (JP)

( * ) Notice: Subject to any disclaimer, the term of this patent is extended or adjusted under 35 U.S.C. 154(b) by 263 days.

(21) Appl. No.: 12/699,448

(22) Filed: Feb. 3, 2010

(65) Prior Publication Data

US 2011/0049145 A1 Mar. 3, 2011

(30) Foreign Application Priority Data

Sep. 1, 2009 (JP) ..... 2009-201311

(51) Int. Cl.
*B65D 6/18* (2006.01)

(52) U.S. Cl. ..... 220/7; 220/6

(58) Field of Classification Search ..... 220/6, 7, 220/4.28

See application file for complete search history.

(56) References Cited

U.S. PATENT DOCUMENTS

| | | | | |
|---|---|---|---|---|
| 5,207,899 | A | 5/1993 | Boyle | |
| 5,632,392 | A * | 5/1997 | Oh | 220/7 |
| 6,290,081 | B1 | 9/2001 | Merey | |
| 6,843,386 | B2 * | 1/2005 | Raghunathan et al. | 220/7 |
| 7,011,225 | B2 * | 3/2006 | Oster et al. | 220/7 |
| 7,195,128 | B2 * | 3/2007 | Murakami et al. | 220/7 |
| 7,861,878 | B2 | 1/2011 | Escarpa | |
| 2003/0000950 | A1 | 1/2003 | Murakami et al. | |
| 2010/0230406 | A1 | 9/2010 | Yamauchi | |
| 2010/0320202 | A1 | 12/2010 | Yamauchi | |
| 2011/0049145 | A1 | 3/2011 | Yamauchi | |

OTHER PUBLICATIONS

United States Office Action dated Nov. 21, 2011, issued in corresponding U.S. Appl. No. 12/544,310. Note: It was only understood that the present application was rejected based on double patenting over said corresponding application only after said Office Action of Nov. 21, 2011. Attention to both said applications is requested.

* cited by examiner

*Primary Examiner* — Stephen Castellano
(74) *Attorney, Agent, or Firm* — Westerman, Hattori, Daniels & Adrian, LLP

(57) ABSTRACT

A folding container includes a lock member L disposed on each of side walls 3 brought down first, the lock member L including a pair of lock bars Lb movable in a horizontal direction and one operation portion La, an inclined spring member 12 provided in the operation portion and including a tip portion placed in a spring receiving and supporting block 3*n* formed on each of the side walls brought down first, a cam hole portion 21*a* formed in each of the lock bars and into which a driven short shaft 15 formed on the operation portion is inserted, and a spring member 22 formed on each of the lock bars and configured to come into abutting contact with a spring member abutting block 3*x* formed on each of the side walls brought down first, so that when the lock bars are moved in a direction in which the lock bars approach each other, the operation portion is prevented from being moved by movement of the lock bars in the direction in which the lock bars approach each other.

3 Claims, 22 Drawing Sheets

La

La

FOLDING CONTAINER

FIELD OF THE INVENTION

The present invention relates to a folding container in which side walls disposed so as to surround a bottom portion can be folded so as to overlap the bottom portion.

BACKGROUND OF THE INVENTION

A folding container is conventionally known which includes long side walls coupled, via hinge members, to respective opposite long side portions of a bottom portion formed so as to have a substantially rectangular planar shape, and short side walls also coupled, via hinge members, to respective opposite short side portions of the bottom portion. The folding container is assembled into box form by raising the long side walls and the short side walls substantially perpendicularly to the bottom portion. Furthermore, when the folding container is folded, the long side walls and the short side walls are folded so as to overlap the bottom portion. When the folding container is in assembled box form, the long side walls or the short side walls are locked by lock members so as not to fall down toward the bottom portion.

For example, U.S. Pat. No. 6,290,081 discloses a lock member disposed on a short side wall and including one operation portion movable along the wall surface of the short side wall, paired lock bars movable in a horizontal direction, and a vertical motion-horizontal motion conversion mechanism composed of inclined cam grooves formed in the respective lock bars and a driven short shaft projected from the operation portion, the vertical motion-horizontal motion conversion mechanism converting vertical motion of the operation portion into horizontal motion of the lock bars.

If the operation portion is located at a lower position, the tip portion of each of the lock bars is inserted into a fitting recess portion formed in the corresponding long side wall. Thus, each of the short side walls is locked on the long side walls via the lock members so as not to fall down toward the bottom portion. Furthermore, the operation portion located at the lower position is moved upward along the wall surface of the short side wall to move the paired lock bars closer to each other in the horizontal direction. This allows the tip portions of the lock bars to be discharged from the fitting recess portions formed in the respective long side walls. Consequently, the lock state is cancelled in which the short side walls are locked on the long side walls via the lock members. Therefore, the short side walls can be brought down so as to overlap the bottom portion.

According to the above-described conventional folding container, to fold the folding container assembled in box form, an operator moves the operation portion upward. However, depending on the position of the operator's hand with respect to the operation portion, the operation portion fails to maintain a horizontal state but is inclined while being moved upward. If the operation portion is inclined while being moved upward, the operation portion hinders smooth horizontal movement of the paired lock bars coupled together via the vertical motion-horizontal motion conversion mechanisms. This may disadvantageously prevent the reliable cancelation of the lock state in which the long side walls are locked on the short side walls via the vertical motion-horizontal motion conversion mechanisms.

Furthermore, a handling through-hole into which the operator's hand is inserted in order to carry the folding container assembled in box form is located close to an operation portion operating recess portion into which the operator places the hand in order to move the operation portion of the lock member upward or downward. Thus, when carrying the folding container assembled in box form, the operator may inadvertently place the hand in the operation portion operating recess portion to move the operation portion upward to cancel the lock state of the short side walls and the long side walls.

Moreover, the paired lock bars are horizontally moved via the vertical motion-horizontal motion conversion mechanism. Hence, a strong force is required to move the lock bars in the horizontal direction. This may disadvantageously prevent operations of folding and assembling the folding container from being properly performed.

Furthermore, when the folding container is in assembled box form, the operation portion, and a leaf spring and the vertical motion-horizontal motion conversion mechanism which are included in the operation portion are arranged in the operation portion operating recess portion that is open to the outside of the short side wall. Thus, an external member may be inadvertently placed in the operation portion operating recess portion, thus damaging the operation portion and the leaf spring and vertical motion-horizontal motion conversion mechanism which are included in the operation portion.

An object of the present invention is to solve the above-described problems with the conventional folding container.

SUMMARY OF THE INVENTION

To accomplish the above-described object, the present invention provides a folding container including a first pair of opposite side walls brought down first toward a bottom portion and a second pair of opposite side walls brought down toward the bottom portion after the first pair of opposite side walls has been brought down, wherein first, the folding container comprises a lock member disposed on each of the side walls brought down first, the lock member comprising a pair of lock bars movable in a horizontal direction and one operation portion, an inclined spring member provided in the operation portion and including a tip portion placed in a spring receiving and supporting block formed on each of the side walls brought down first, a cam hole portion formed in each of the lock bars and into which a driven short shaft formed on the operation portion is inserted, and a spring member formed on each of the lock bars and configured to come into abutting contact with a spring member abutting block formed on each of the side walls brought down first, so that when the lock bars are moved in a direction in which the lock bars approach each other, the operation portion is prevented from being moved by movement of the lock bars in the direction in which the lock bars approach each other, wherein second, when the operation portion included in the lock member is pivotally moved inward downward in the folding container using, as a pivotal movement supporting point, a pivotal short shaft formed on the operation portion and fitted in a fitting recess portion of a pivotal short-shaft supporting block formed on each of the side walls brought down first, a lock state in which the side walls brought down first are locked on the side walls brought down second is cancelled, and wherein third, a central space portion formed in each of the side walls brought down first is covered by a cover member.

The folding container includes the first pair of opposite side walls brought down first toward the bottom portion and the second pair of opposite side walls brought down toward the bottom portion after the first pair of opposite side walls has been brought down, and comprises the lock member disposed on each of the side walls brought down first, the lock member comprising the pair of lock bars movable in the horizontal direction and the one operation portion, the inclined spring member provided in the operation portion and including the tip portion placed in the spring receiving and supporting block formed on each of the side walls brought down first, the cam hole portion formed in each of the lock bars and into which the driven short shaft formed on the operation portion is inserted, and the spring member formed on each of the lock bars and configured to come into abutting contact with a spring member abutting block formed on each of the side walls brought down first, so that when the lock bars are moved in the direction in which the lock bars approach each other, the operation portion is prevented from being moved by movement of the lock bars in the direction in which the lock bars approach each other. Thus, each of the lock bars simply elastically deforms the spring member formed on the lock bar. This reduces a load imposed on the pair of lock bars when the lock bars are horizontally moved in the direction in which the lock bars approach each other. Thus, an operation of assembling the folding container is facilitated.

Furthermore, when the operation portion included in the lock member is pivotally moved inward downward in the folding container using, as a pivotal movement supporting point, the pivotal short shaft formed on the operation portion and fitted in the fitting recess portion of the pivotal short-shaft supporting block formed on each of the side walls brought down first, the lock state in which the side walls brought down first are locked on the side walls brought down second is cancelled. Thus, regardless of where on the top surface of the operation portion formed on an operation main body included in the operation portion, an operator's finger is located, the laterally paired lock bars, disposed across the operation portion, have the same horizontal travel distance. This enables reliable cancellation of the lock state in which the first pair of opposite side walls are locked, via the lock members, on the second pair of opposite side walls brought down toward the bottom portion after the first pair of opposite side walls has been brought down.

Moreover, the central space portion formed in each of the side walls brought down first is covered by the cover member. Thus, the operation portion and lock bars included in the lock member located in the central space portion are prevented from being exposed to the outside of each of the side walls brought down first. Therefore, the operation portion and lock bars included in the lock member located in the central space portion can be prevented from being damaged by an external member.

DETAILED DESCRIPTION OF THE PREFERRED EMBODIMENTS

An embodiment of the present invention will be described below. However, the present invention is not limited to the present embodiment unless the spirits of the present invention are departed from.

Figure 1:
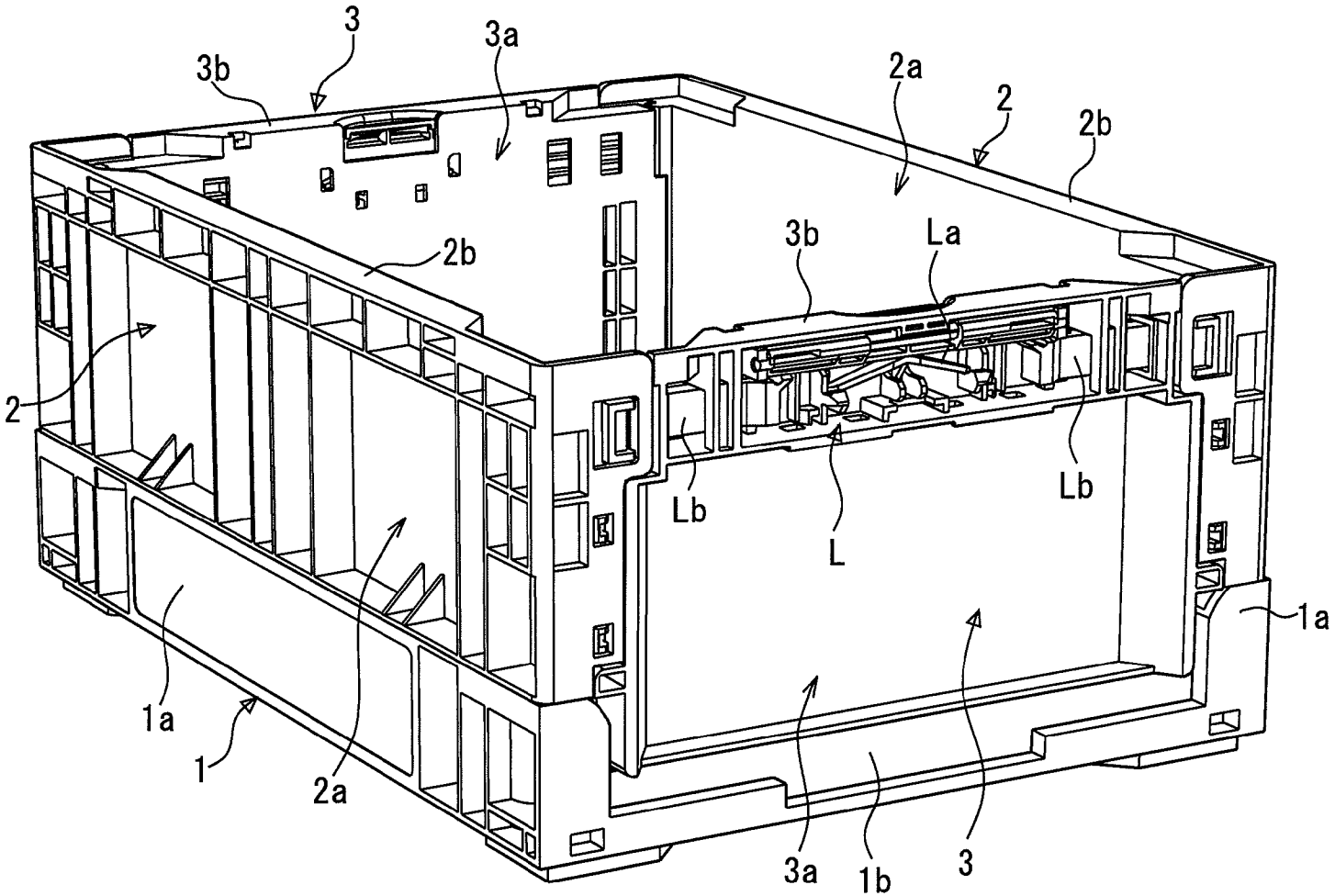
FIG. 1 is a general perspective view showing that a folding container according to the present invention has been assembled in box form, with a cover member omitted.

As shown in FIG. 1, a folding container according to the present invention includes a bottom portion 1, long side walls 2 hinged to respective opposite long side embankment portions 1*a* of the bottom portion 1, and short side walls 3 hinged to respective opposite short side embankment portions 1*b* of the bottom portion 1. In the present embodiment, each of the long side embankment portions 1*a* is formed to be higher than each of the short side embankment portions 1*b*.

As is well known, the folding container assembled in box form as shown in FIG. 1 can be folded into a low compact form as follows. First, the short side walls 3 are brought down so as to overlap the bottom portion 1. Then, the long side walls 2 are then brought down so as to overlap the short side walls 3 laid on top of the bottom portion 1. The folding container folded as described above can be assembled into box form as shown in FIG. 1, as follows. First, the long side walls 2 are raised vertically. Then, the short side walls 3 are raised vertically.

Figure 2:
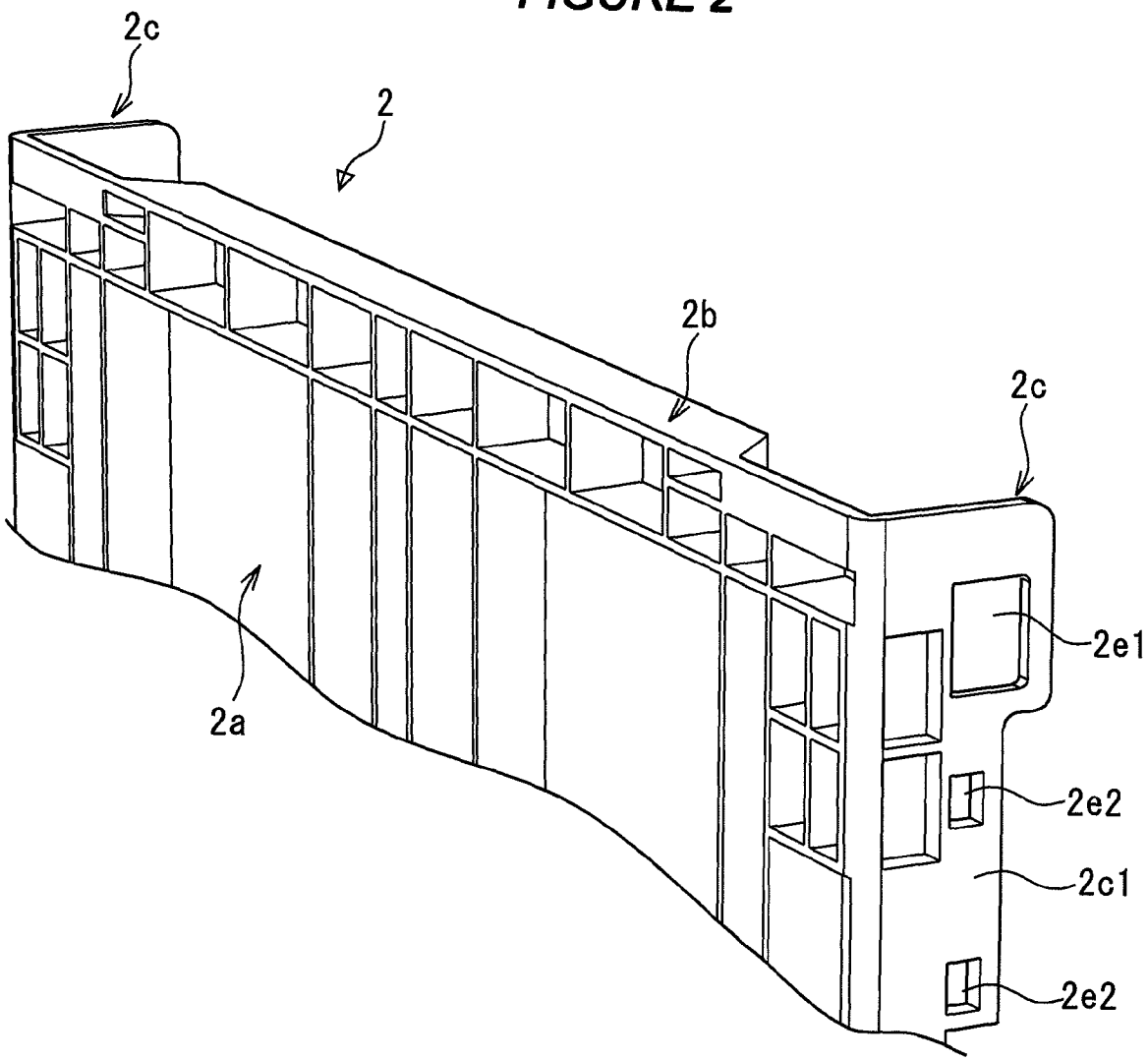
FIG. 2 is a partial perspective view of a long side wall included in a folding container according to the present invention.
Figure 3:
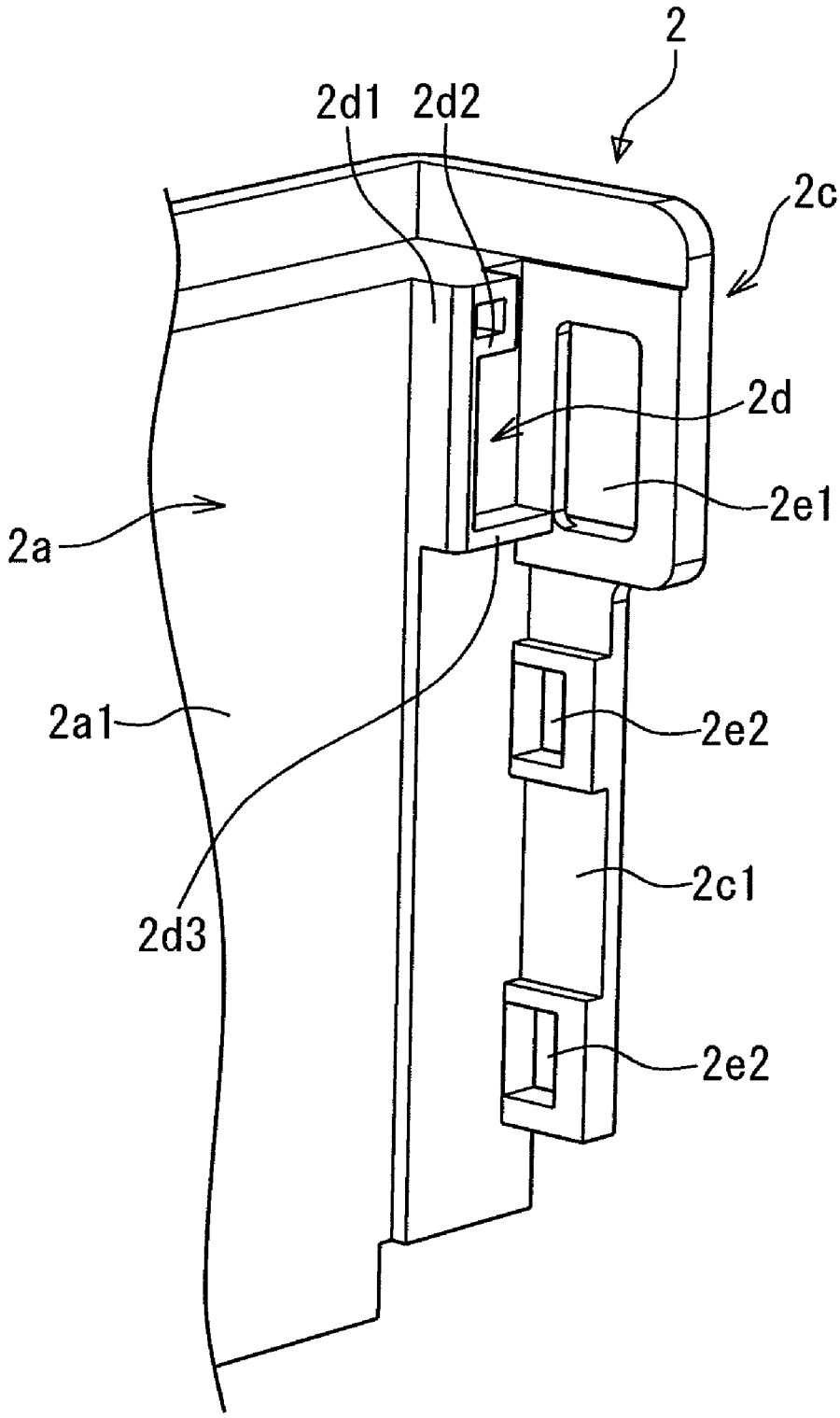
FIG. 3 is a partly enlarged perspective view of the long side wall included in the folding container according to the present invention.
Figure 4:
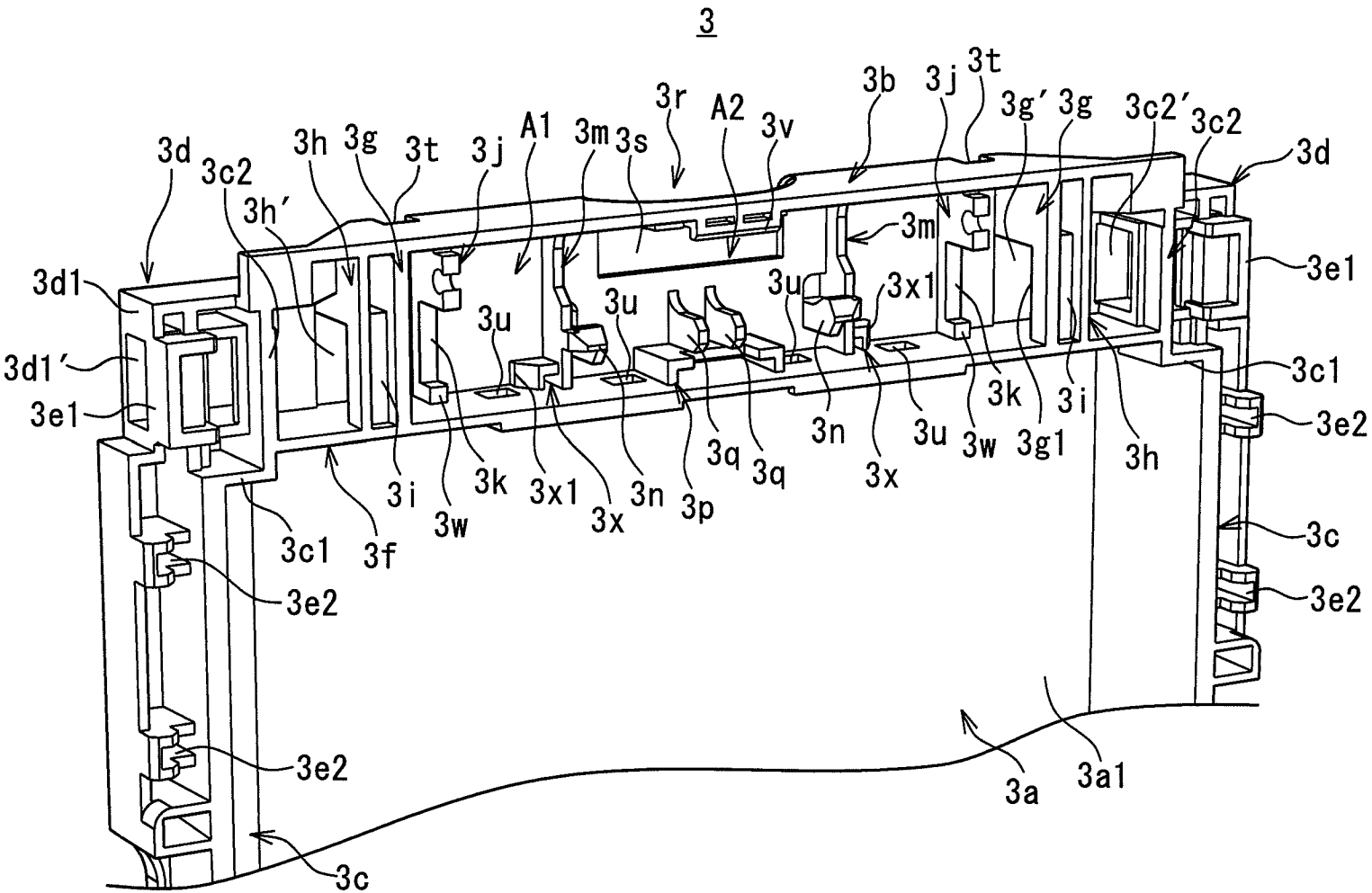
FIG. 4 is a partial perspective view of a short side wall included in the folding container according to the present invention as viewed from the outside of the folding container.
Figure 5:
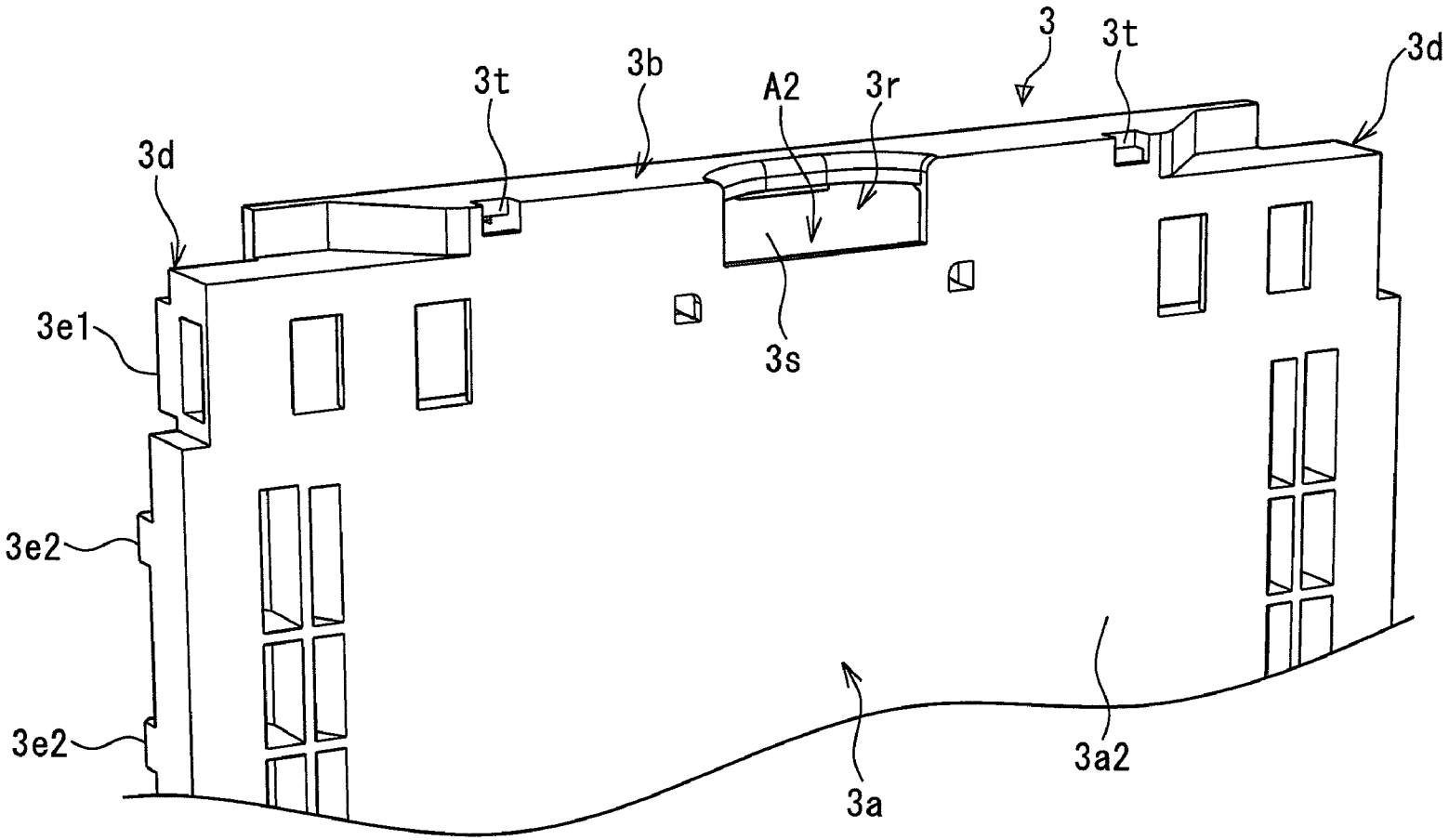
FIG. 5 is a partial perspective view of the short side wall included in the folding container according to the present invention as viewed from the inside of the folding container.
Figure 6:
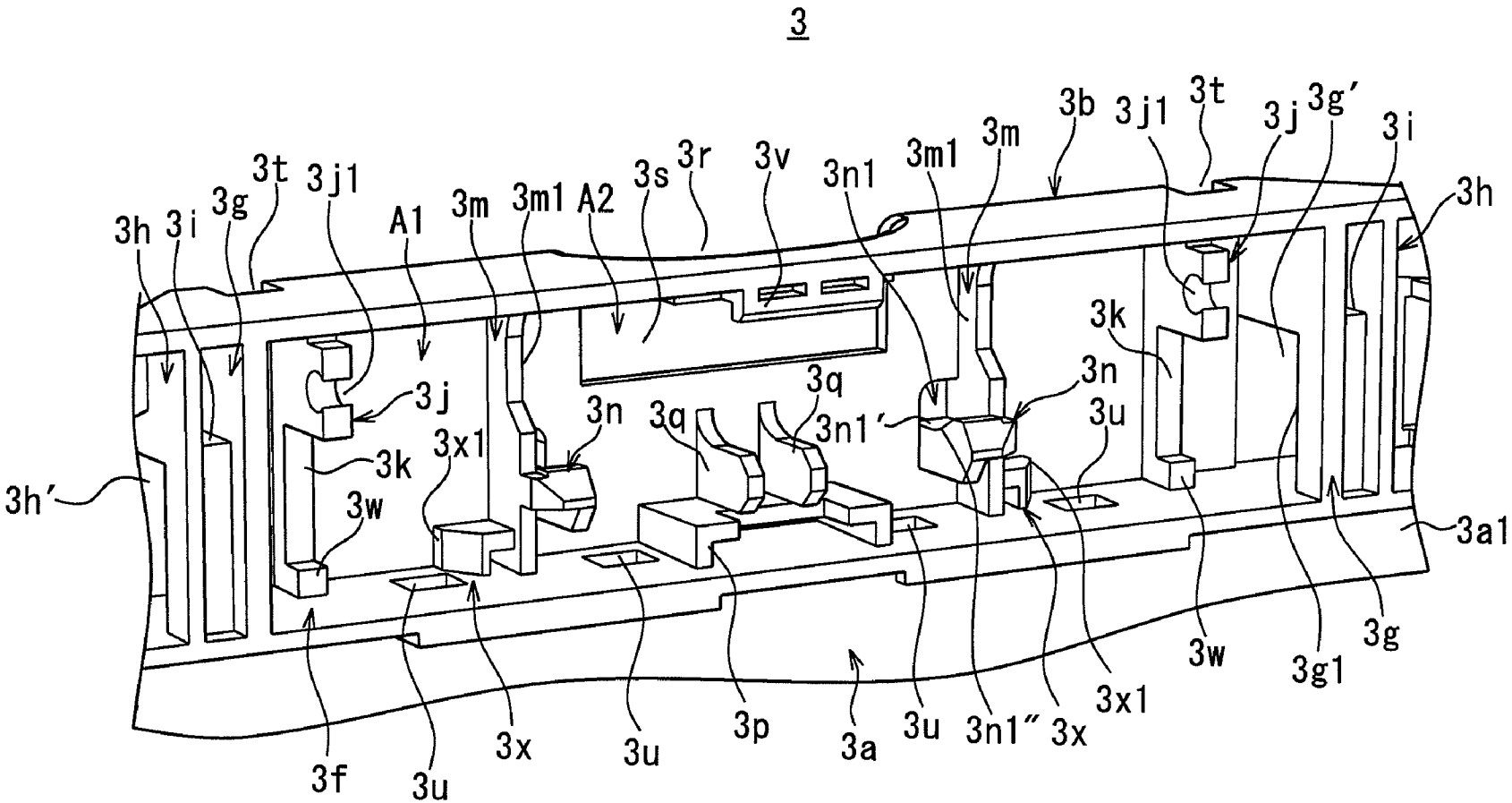
FIG. 6 is a partly enlarged perspective view of the short side wall shown in FIG. 4.
Figure 7:
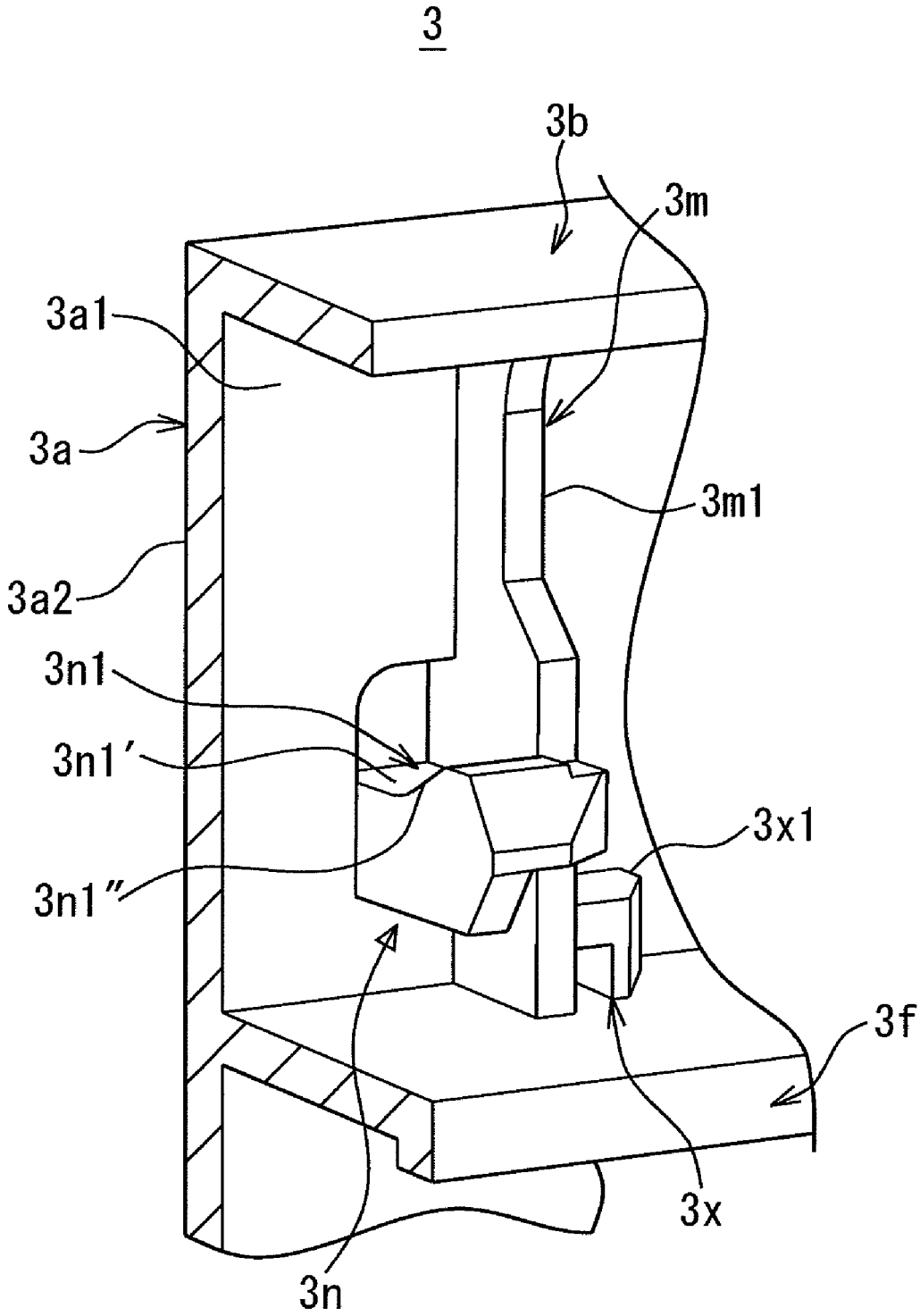
FIG. 7 is a further, partly enlarged perspective view of the short side wall shown in FIG. 4.

Now, the long side wall 2 will be described with reference to FIGS. 1 to 3.

The long side wall 2 includes a substantially square plate-like portion 2*a*. An upper-end horizontal flange 2*b* is formed at the upper end of the long side wall 2. Furthermore, vertically long, long side wall-side engaging members 2*c* are formed at respective opposite vertical ends of the long side wall 2; each of the long side wall-side engaging members 2*c* is substantially perpendicular to the plate-like portion 2*a* and is also perpendicular to the inner surface (the surface positioned, when the folding container is folded into box form, inside the folding container assembled in box form) 2*a*1 of the plate-like portion 2*a*. At an upper end of a corner formed by a vertical, vertically long band-like plate (hereinafter referred to as an end vertically-long band-like plate) 2*c*1 and the inner surface 2*a*1 of the plate-like portion 2*a*, an engaging recess portion 2*d* is formed. The engaging recess portion 2*d* is surrounded by the end vertically-long band-like plate 2*c*1, a vertical side wall 2*d*1 parallel to the end vertically-long band-like plate 2*c*1, a top plate 2*d*2 configured to couple the upper end of the vertical side wall 2*d*1 and the end vertically-log band-like plate 2*c*1 together, a bottom plate 2*d*3 configured to couple the lower end of the vertical side wall 2*d*1 and the end vertically-log band-like plate 2*c*1 together, and the plate-like portion 2*a*. Furthermore, an upper-end fitting hole 2*e*1 is formed at the upper end of the above-described end vertically-long band-like plate 2*c*1. An appropriate number of fitting holes 2*e*2 are formed in the end vertically-long band-like plate 2*c*1, positioned below the upper-end fitting hole 2*e*1. In the illustrated example in the present embodiment, two fitting holes 2*e*2 are formed.

Now, the short side wall 3 will be described with reference to FIGS. 1 and 4 to 7.

The short side wall 3 includes a substantially square plate-like portion 3*a*, and an upper-end horizontal flange 3*b* formed at the upper end of the short side wall 3. Furthermore, vertically long, end vertical ribs 3*c* are formed at respective opposite vertical ends of the short side wall 3; each of the end vertical ribs 3*c* extends perpendicularly to the plate-like portion 3*a* toward the outer surface (the surface positioned, when the folding container is folded into box form, outside the folding container assembled in box form) 3*a*1 of the plate-like portion 3*a*.

Outside the end vertical ribs 3*c*, a vertically long, short side wall-side engaging member 3*d* is extended along the plate-like portion 3*a*. Upper-end fitting projecting portions 3*e*1 perpendicular to the plate-like portion 3*a* is formed at the upper end of the short side wall-side engaging member 3*d*. Furthermore, an appropriate number of fitting projecting portions 3*e*2 are formed under the upper-end fitting projecting portion 3*e*2. In the illustrated example in the present embodiment, two fitting hole fitting projecting portions 3*e*2 are formed.

As shown in FIG. 1, when the folding container is folded into box form, the upper-end fitting projecting portion 3*e*1 formed at the upper end of the short side wall-side engaging member 3*d* of the long side wall 3 is fitted into the upper-end fitting hole 2*e*1 formed at the upper end of the long side wall-side engaging member 2*c* of the long side wall 2. Furthermore, the fitting projecting portion 3*e*2 formed on the short side wall-side engaging member 3*d* of the short side wall 3 is fitted into the fitting hole 2*e*2 formed in the long side wall-side engaging member 2*c* of the long side wall 2.

An upper horizontal rib 3*f* is formed at the top of the outer surface 3*a*1 of the plate-like portion 3*a* forming the short side wall 3 and at a predetermined distance from the upper-end horizontal flange 3*b*. The upper horizontal rib 3*f* extends to the end vertical rib 3*c*. The upper-end horizontal flange 3*b* and the upper-end horizontal rib 3*f* are coupled together by an upper-end vertical portion 3*c*2 extending vertically via an upper horizontal portion 3*c*1 of the end vertical rib 3*c*. Furthermore, opposite, paired closer-to-center coupling vertical ribs 3*g* are formed at a predetermined distance from each other so as to couple a central area of the upper-end horizontal flange 3*b* and a central area of the upper horizontal rib 3*f* together. Closer-to-end coupling vertical ribs 3*h* are formed closer to the respective end vertical ribs 3*c* than the respective closer-to-center coupling vertical rib 3*g* and at a predetermined distance from each other. Moreover, a vertically long coupling block 3*i* configured to couple the closer-to-center coupling vertical rib 3*g* and the closer-to-end coupling vertical rib 3*h* together is formed in the gap between the closer-to-center coupling vertical rib 3*g* and the closer-to-end coupling vertical rib 3*h*. The closer-to-end coupling vertical rib 3*h* and the vertically long coupling block 3*i* may be appropriately omitted. A coupling vertical rib configured to couple the upper-end horizontal flange 3*b* and the upper horizontal rib 3*f* together may additionally be provided between the upper-end vertical portion 3*c*2 of the end vertical rib 3*c* and the closer-to-center coupling vertical rib 3*g*.

A central space portion A1 covered by a cover member 4 described below is formed by the upper-end horizontal flange 3*b*, the upper horizontal rib 3*f*, the opposite, paired closer-to-center coupling vertical rib 3*g*, and the outer surface 3*a*1 of the plate-like portion 3*a*, all of which are described above.

A lock bar insertion hole through which a lock bar described below can be inserted is drilled in each of the vertical end wall 3*d*1 included in the short side wall-side engaging member 3*d*, the upper-end vertical portion 3*c*2 of the end vertical rib 3*c*, the closer-to-end coupling vertical rib 3*h*, the vertically long coupling block 3*i*, and the closer-to-center coupling vertical rig 3*g*, all of which are described above; the lock bar insertion holes in the above-described components appear to communicate with one another as viewed from the vertical end wall 3*d*1 of the short side wall-side engaging member 3*d*. The lock bar insertion holes include a lock bar insertion hole 3*d*1' drilled in the vertical end wall 3*d*1 of the short side wall-side engaging member 3*d*, a lock bar insertion hole 3*c*2' drilled in the upper-end vertical portion 3*c*2 of the end vertical rib 3*c*, a lock bar insertion hole 3*h*' drilled in the closer-to-end coupling vertical rib 3*h*, a lock bar insertion hole (not shown in the drawings) drilled in the vertically long coupling block 3*i*, and a lock bar insertion hole 3*g*' drilled in the closer-to-center coupling vertical rig 3*g*.

Paired pivotal short-shaft supporting blocks 3*j* are formed on a part of the plate-like portion 3*a* positioned in the central space A1 and close to the upper-end horizontal flange 3*b*, and the paired pivotal short-shaft supporting blocks 3*j* extend perpendicularly to the outer surface 3*a*1 of the plate-like portion 3*a*. A fitting recess portion 3*j*1 is formed in the pivotal short-shaft supporting block 3*j*. 3*k* is a vertical reinforcing rib formed on the plate-like portion 3*a* so as to couple the pivotal short-shaft supporting block 3*j* and the upper horizontal rib 3*f* together.

Paired spring receiving and supporting vertical rib 3*m* is formed on the plate-like portion 3*a* positioned closer to the center of the pivotal short-shaft supporting block 3*j* so as to couple the upper-end horizontal flange 3*b* and the upper horizontal rib 3*f* together. A spring receiving and supporting block 3*n* is formed on the lower portion of a corner formed by each of the opposite side surfaces 3*m*1 of the paired spring receiving and supporting vertical rib 3*m* and the outer surface 3*a*1 of the plate-like portion 3*a*. Furthermore, the tip of the spring receiving and supporting block 3*n* is formed to project from the tip of the spring receiving and supporting vertical rib 3*m*. The top surface 3*n*1 of the spring receiving and supporting block 3*n* is formed by a horizontal surface 3*n*1' extending from the outer surface 3*a*1 of the plate-like portion 3*a* and an inclined surface 3*n*1" extending upward from the end of the horizontal surface 3*n*1'.

A pedestal 3*p* is formed on a corner formed by the outer surface 3*a*1 of the plate-like portion 3*a* and a part of the top surface of the upper horizontal rib 3*f* which is positioned in the central portion between the opposite, paired spring receiving and supporting vertical rib 3*m*. Paired reinforcing vertical pieces 3*q* are provided upright on a corner formed by the top surface of the pedestal 3*p* and the outer surface 3*a*1 of the plate-like portion 3*a*.

A recess portion 3*r* with a circular-arc planar shape is formed in a central portion of the upper-end horizontal flange 3*b*; the recess portion 3*r* extends from the inner surface (the surface positioned, when the folding container is folded into box form, inside the folding container assembled in box form) 3*a*2 of the plate-like portion 3*a* toward the outer surface 3*a*1 of the plate-like portion 3*a*. A horizontally long, rectangular through hole 3*s* configured to communicate with the circular-arc recess portion 3*r* is formed in a part of the plate-like portion 3*a* at which the circular-arc recess portion 3*r* is positioned. An operation portion insertion space portion A2 is formed, by the circular-arc recess portion 3*r* and the rectangular through-hole 3*s*, in a central portion of the inner upper corner of each of the short side walls 3 of the folding container assembled in box form.

A cutout through-hole 3*t* is formed close to each of the opposite ends of a corner formed by the upper-end horizontal flange 3*b* and the plate-like portion 3*a*. Furthermore, an appropriate number of locking through-holes 3*u* are formed in a part of the upper horizontal rib 3*f* which is positioned in the central space portion A1. In the illustrated example in the present embodiment, four cutout through-holes 3*u* are formed. Moreover, an elastically deformable, elastic locking piece 3*v* extending perpendicularly to the upper-end horizontal flange 3*b* is suspended from a part of the bottom surface of the upper-end horizontal flange 3*b* which is positioned in a central portion of the rectangular through-hole 3*s* formed in the plate-like portion 3*a* and forming the above-described operation portion insertion space portion A2. A lock bar bottom surface supporting block 3*w* configured to guide and support the bottom surface of the lock bar described below is formed on a corner formed by the top surface of the upper horizontal rib 3*f* and the vertical reinforcing rib 3*k* formed so as to couple the pivotal short-shaft supporting block 3*j* and the upper horizontal rib 3*f* together.

Furthermore, a spring member abutting block 3*x* is formed on a corner formed closer to the short side wall-side engaging member 3*d* by the spring receiving and supporting vertical rib 3*m* and the upper horizontal rib 3*f* so that the tip portion of a spring member formed on the lock bar included in the lock member described below can come into abutting contact with the spring member abutting block 3*x*.

Figure 8:
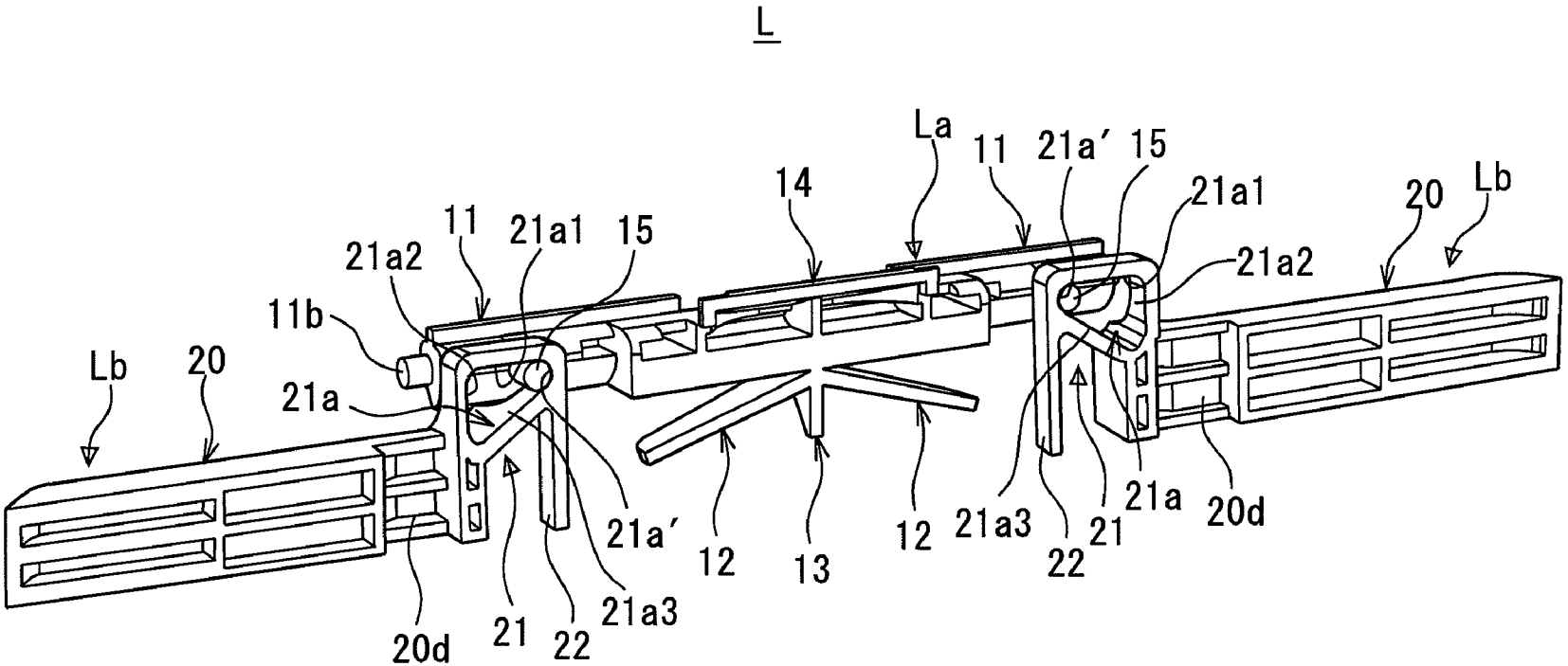
FIG. 8 is a perspective view of a lock member included in the folding container according to the present invention.
Figure 9:
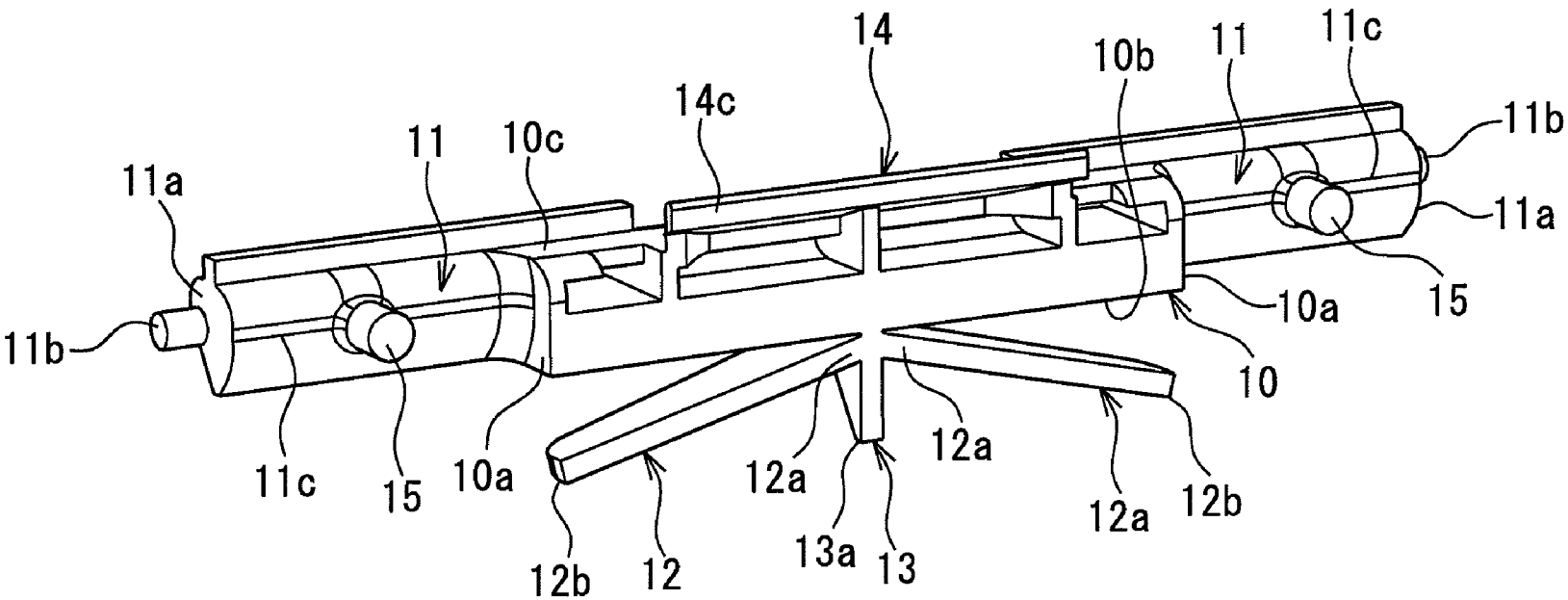
FIG. 9 is a perspective view of an operation portion included in the lock member of the folding container according to the present invention.
Figure 10:
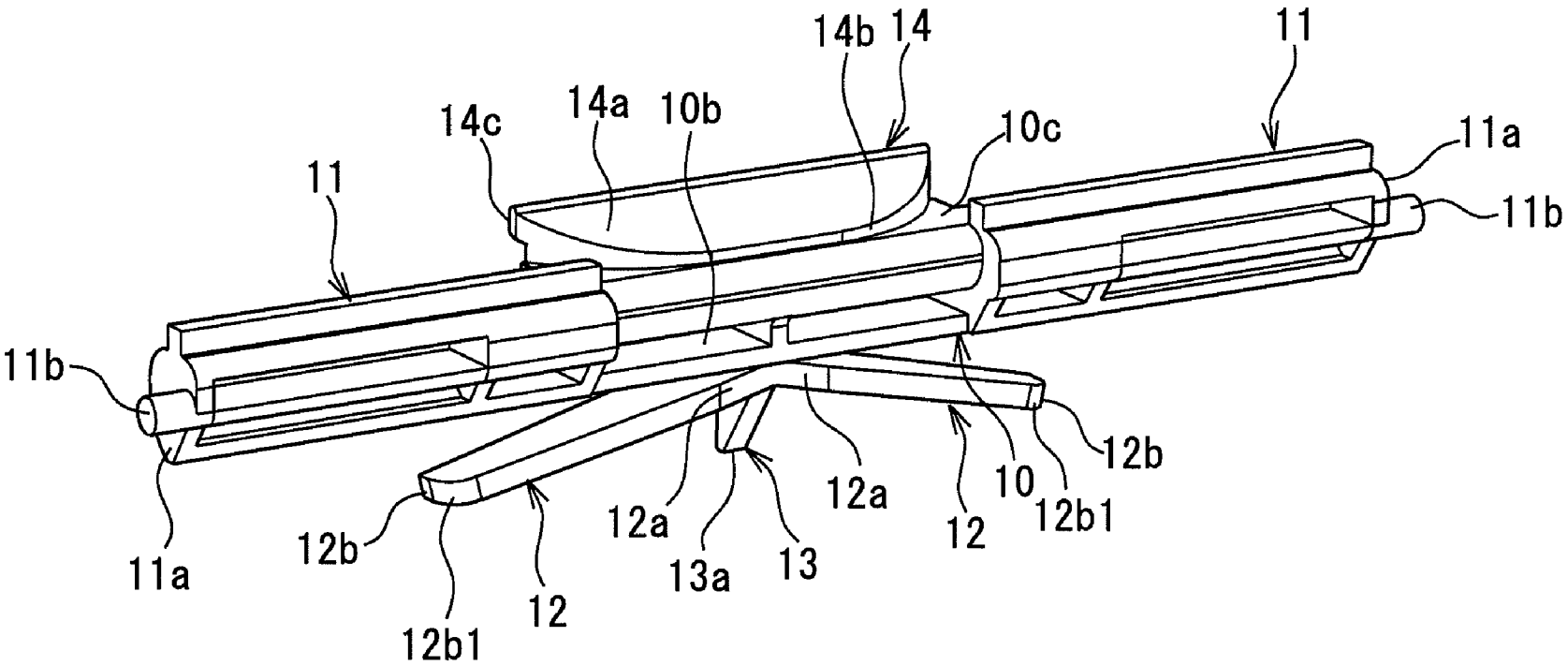
FIG. 10 is also a perspective view of the operation portion included in the lock member of the folding container according to the present invention.

Now, a lock member L including one operation portion La and paired lock bars Lb will be described with reference to FIGS. 8 to 10.

The operation portion La includes a horizontally long, substantially prismatic operation main body 10, and two horizontal arms 11 formed on respective opposite vertical side surfaces 10*a* of the operation main body 10. Furthermore, a pivotal short shaft 11*b* is formed on a leading vertical surface 11*a* of each of the horizontal arms 11. Moreover, inclined spring members 12 formed as paired band-like plate members are formed are formed in a central portion of a lower horizontal plate portion 10*b* included in the operation main body 10 so as to extend away from each other and along the longitudinal direction of the operation main body 10. Additionally, an inclined spring protect piece 13 is formed perpendicularly to the lower horizontal plate portion 10*b* of the operation main body 10, on a part of the lower horizontal plate portion 10*b* of the operation main body 10 which is positioned in a central portion of a root portion 12*a* of the paired inclined spring members 12. A vertical distance from the bottom surface of the lower horizontal plate portion 10*b* to the lower end 13*a* of the inclined spring member protect piece 13 is substantially the same as that from the bottom surface of the lower horizontal plate portion 10*b* to the tip portion 12*b* of the inclined spring member 12. In other words, the lower end 13*a* of the inclined spring member protect piece 13 and the tip portion 12*b* of the inclined spring member 12 are positioned on substantially the same horizontal surface. In this configuration, the operation portion La corresponding to a part accommodated in the box comes into abutting contact with the side wall or the like of the box. Even if the paired inclined spring members 12 act to tilt excessively, the inclined spring member protect piece 13 can come into abutting contact with the side wall or the like of the box to prevent the inclined spring members 12 from being excessively deformed. The inclined spring members 12 can thus be prevented from being damaged. The inclined spring member protect piece 13 may be omitted.

14 is a circular-arc operation portion. The top surface 14*a* of the operation portion 14 is formed so as to incline upward with respect to the top surface of the upper horizontal plate portion 10*c* included in the operation main body 10. Furthermore, a circular arc portion 14*b* of the operation portion 14 is positioned on the operation main body 10 side. A linear portion 14*c* of the operation portion 14 is positioned away from the operation main body 10. Furthermore, on a side surface portion 11*c* of each the paired horizontal arms 11 which is positioned on the linear portion 14*c* side of the operation portion 14, a driven short shaft 15 is projected so as to extend in a substantially vertical direction from the side surface portion 11*c*.

Figure 11:
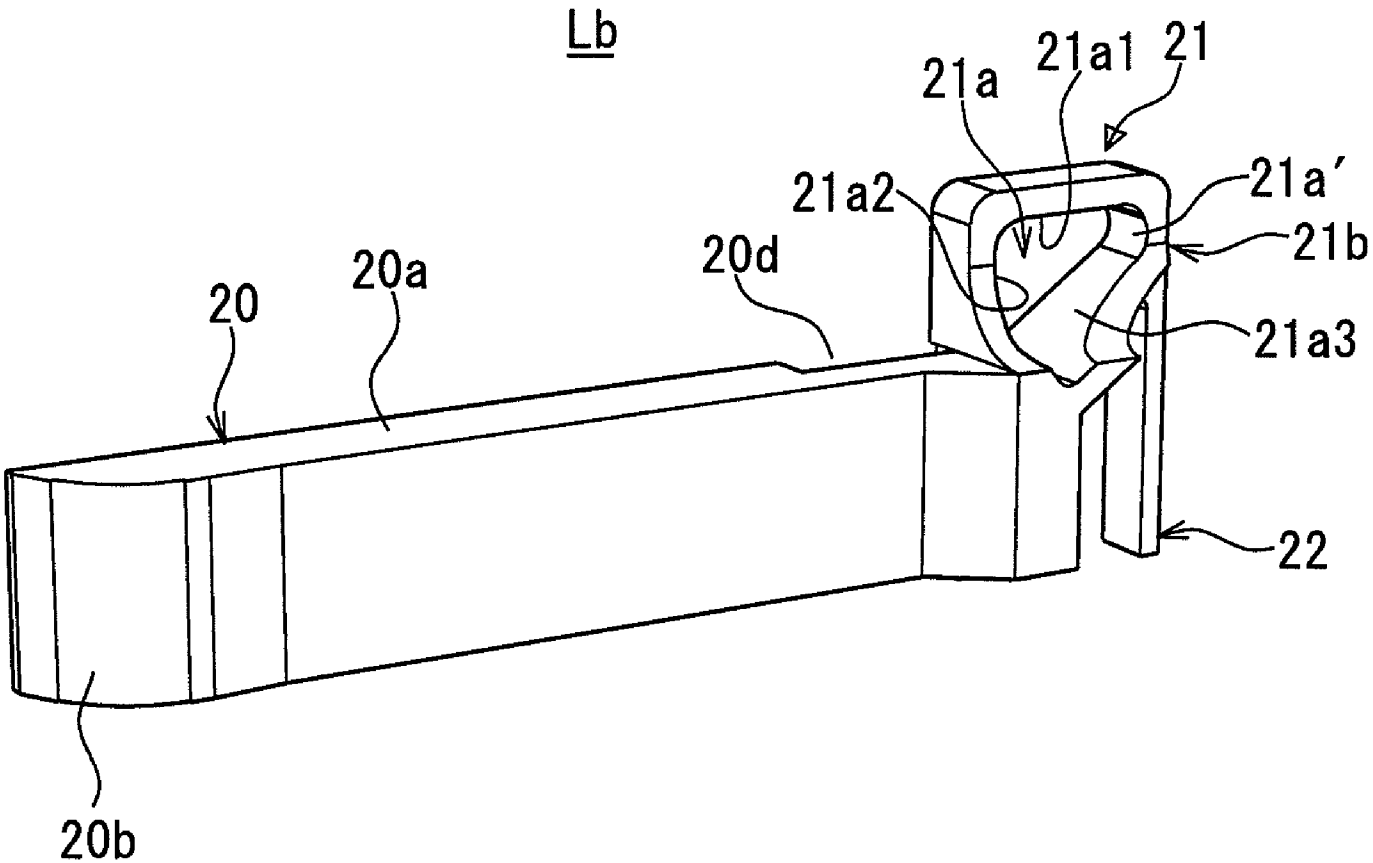
FIG. 11 is a perspective view of a lock bar included in the lock member of the folding container according to the present invention.
Figure 12:
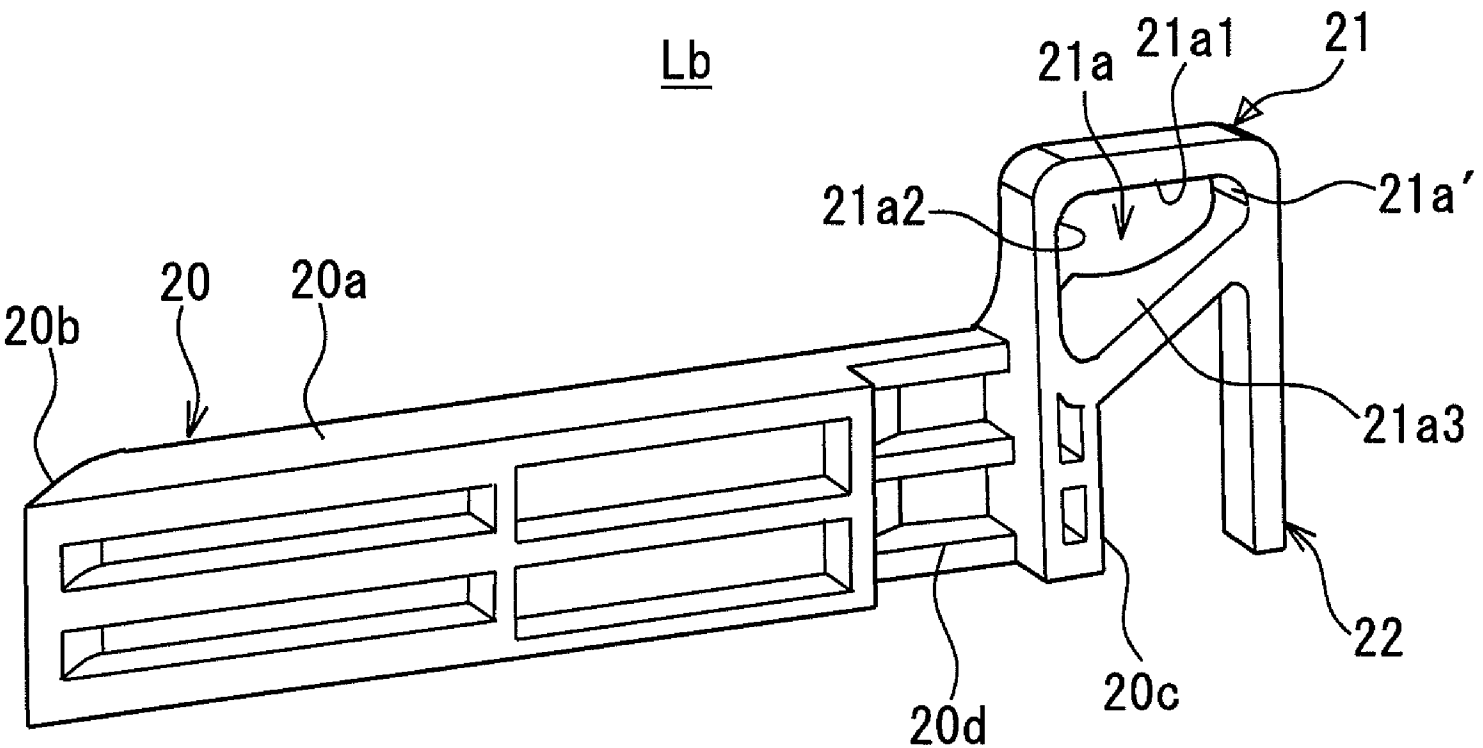
FIG. 12 is also a perspective view of the lock bar included in the lock member of the folding container according to the present invention.

Now, the lock bar Lb will be described with reference to FIGS. 8, 11, and 12.

The lock bar Lb includes a vertical plate-like member 20 and a substantially square cam plate 21 provided upright close to one end of the top surface 20*a* of the plate-like member 20. A substantially triangular cam hole portion 21*a* is drilled in the cam plate 21. Furthermore, an inclined surface 20*b* is formed at a tip portion of the plate-like portion 20 which is positioned opposite the cam plate 21. The cam hole portion 21*a* is formed of a top surface 21*a*1 formed to extend in a substantially horizontal direction, a side wall surface 21*a*2 positioned on the plate-like member 20 side, and an inclined surface 21*a*3 configured to couple the lower end of the side wall surface 21*a*2 to an end of the top surface 21*a*1 which is located farther from the side wall surface 21*a*2.

The vertical tip portion 21*b* of the cam plate 21 is configured to project from the vertical tip portion 20*c* of the plate-like member 20 which is positioned opposite the inclined surface 20*b*. Furthermore, a vertical spring member 22 formed as a band-like plate member extending downward in a substantially vertical direction is formed at the vertical tip portion 21*b* of the cam plate 21. Such a recess portion 20*d* as does not hinder horizontal movement of the lock bar Lb is formed in a part of one side surface of the plate-like member 20 which is positioned close to the cam plate 21 so that the above-described vertical reinforcing rib 3*k* formed to couple the pivotal short-shaft supporting block 3*j* and upper horizontal rib 3*f* together can be inserted into the recess portion 20*d*.

Figure 13:
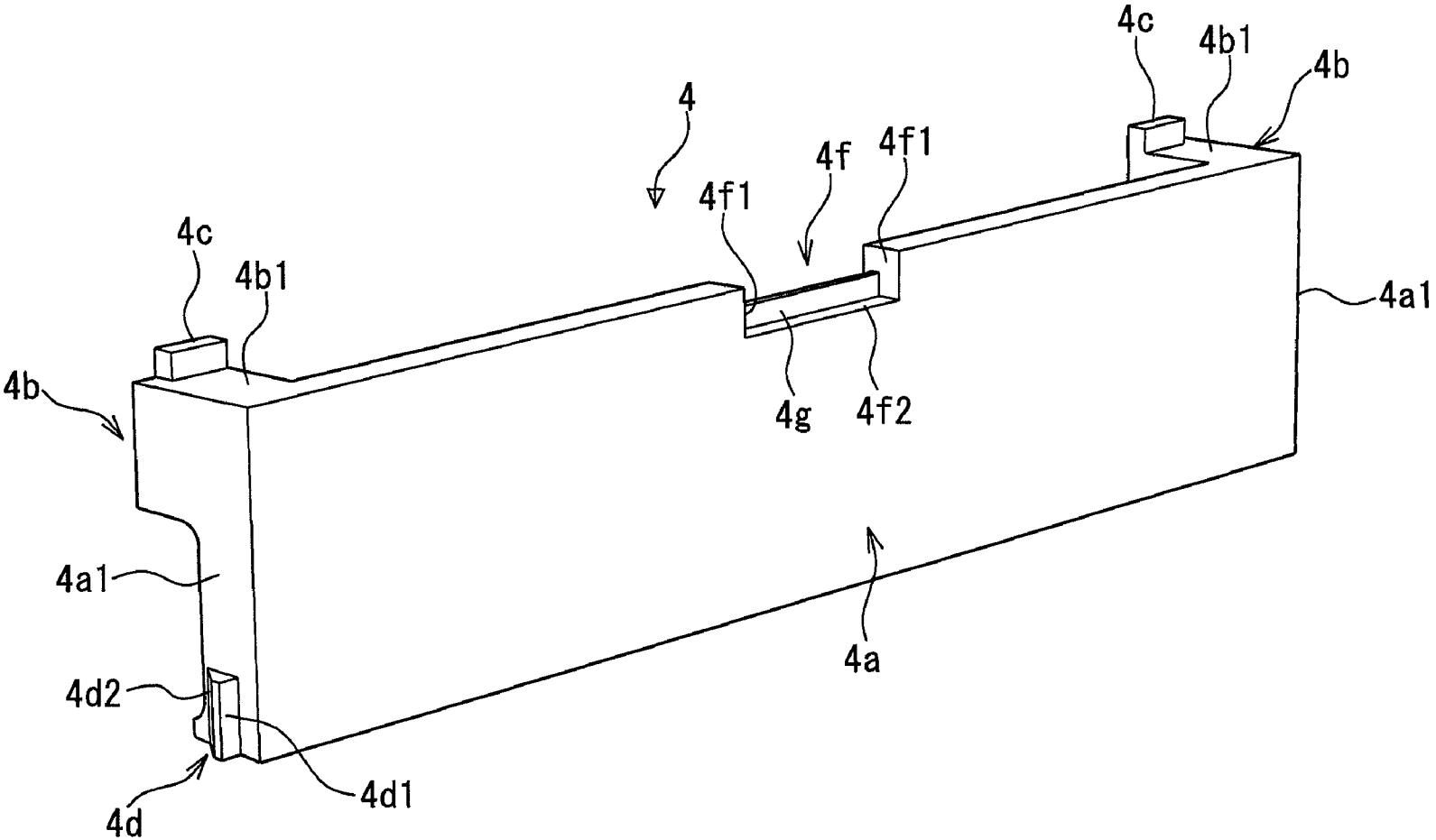
FIG. 13 is a perspective view of a cover member included in the folding container according to the present invention.
Figure 14:
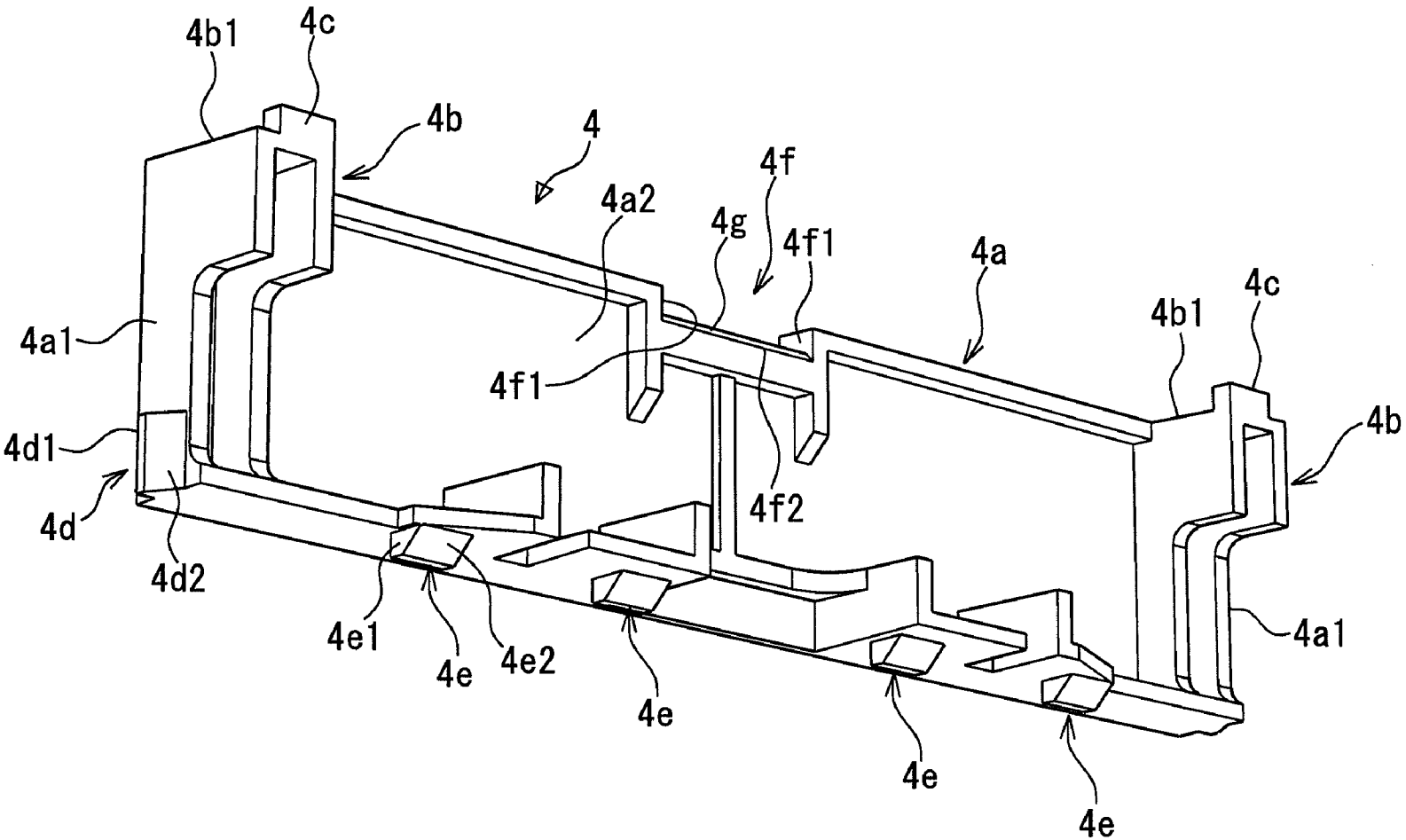
FIG. 14 is also a perspective view of the cover member included in the folding container according to the present invention.

Now, the cover member 4 will be described with reference to FIGS. 13 and 14.

The cover member 4 includes a main body portion 4*a* formed like a horizontally long plate-like member and an upper-end block portion 4*b* extending perpendicularly to the main body portion 4*a* from the upper end of the main body portion 4*a*. Insertion pieces 4*c* are each provided upright at the tip portion of the top surface 4*b*1 of the upper-end block portion 4*b* so as to be inserted into the corresponding cutout through-hole 3*t* formed close to each of the opposite ends of a corner formed by the upper-end horizontal flange 3*b* and plate-like portion 3*a* of the short side wall 3. Furthermore, a triangular-prismatic vertical projecting portion 4*d* is formed at the lower end of each of the opposite vertical side surfaces 4*a*1 of the main body portion 4*a* so that the vertical projecting portion 4*d* can be hooked on an inner edge 3*g*1 positioned closer to the lock bar insertion hole 3*g*' formed in the closer-to-center coupling vertical rib 3*g*. The triangular-prismatic vertical projecting portion 4*d* includes a vertical side surface 4*d*1 extending perpendicularly to the vertical side surface 4*a*1 of the main body portion 4*a*, and a vertical inclined surface 4*d*2 inclined from the vertical tip of the vertical side surface 4*d*1 toward the vertical side surface 4*a*1 of the main body portion 4*a*. The vertical inclined surface 4*d*2 is configured to lie closer to the upper-end block portion 4*b*.

Furthermore, triangular-prismatic horizontal projecting portions 4*e* are suspended from the bottom surface of the main body portion 4*a* so as to be fitted into the respective locking through-holes 3*u* formed in a part of the upper horizontal rib 3*f* of which is positioned in the central space portion A1 formed in the short side wall 3. The triangular-prismatic horizontal projecting portion 4*e* includes horizontal perpendicular surfaces 4*e*1 extending perpendicularly to the main body portion 4*a* and a horizontal inclined surface 4*e*2 inclined from the bottom surfaces of the main body portion 4*a* toward the horizontal perpendicular surfaces 4*e*1.

Moreover, a recess portion 4*f* including opposite side surfaces 4*f*1 and a bottom surface 4*f*2 is formed in a central portion of the top surface of the main body portion 4*a*. An engaging vertical piece 4*g* configured to bridge the opposite side surfaces 4*f*1 is formed on the bottom surface 4*f*2 of the recess portion 4*f*. The elastically deformable elastic locking piece 3*v* suspended from the rear surface of the upper-end horizontal flange 3*b* of the short side wall 3 is locked on the engaging vertical piece 4*g*.

Now, attachment of the lock member L to the short side wall 3 will be described mainly using FIGS. 15 and 16.

First, the tip portion of the plate-like member 20 included in the paired lock bars Lb is inserted through the lock bar insertion hole 3*g*' formed in the closer-to-center coupling vertical rig 3*g*, the lock bar insertion hole formed in the vertically long coupling block 3*i*, the lock bar insertion hole 3*h*' formed in the closer-to-end coupling vertical rib 3*h*, the lock bar insertion hole 3*c*2' formed in the upper-end vertical portion 3*c*2 of the end vertical rib 3*c*, and the lock bar insertion hole 3*d*1' formed in the vertical end wall 3*d*1 of the short side wall-side engaging member 3*d*, in this order. The vertical spring member 22 formed on each of the lock bars Lb is positioned in abutment with or close to the side surface 3*x*1 of the corresponding spring member abutting block 3*x* provided on a corner formed closer to the corresponding short side wall-side engaging member 3*d* by parts of the corresponding spring receiving and supporting vertical rib 3*m* and the upper horizontal rib 3*f* which are formed in the central space portion A1. At this time, the inclined surface 20*b* formed at the tip portion of the plate-like member 20 is positioned on the outer surface 3*a*1 side of the plate-like portion 3*a* of the short side wall 3. As described above, when the paired lock bars Lb are arranged in the central space portion A1 of the short side wall 3, an upper corner 21*a*' formed by the top surface 21*a*1 forming the cam hole portion 21*a* and the upper end of the inclined surface 21*a*3 is positioned closer to the spring receiving and supporting vertical rib 3*m*.

Figure 15:
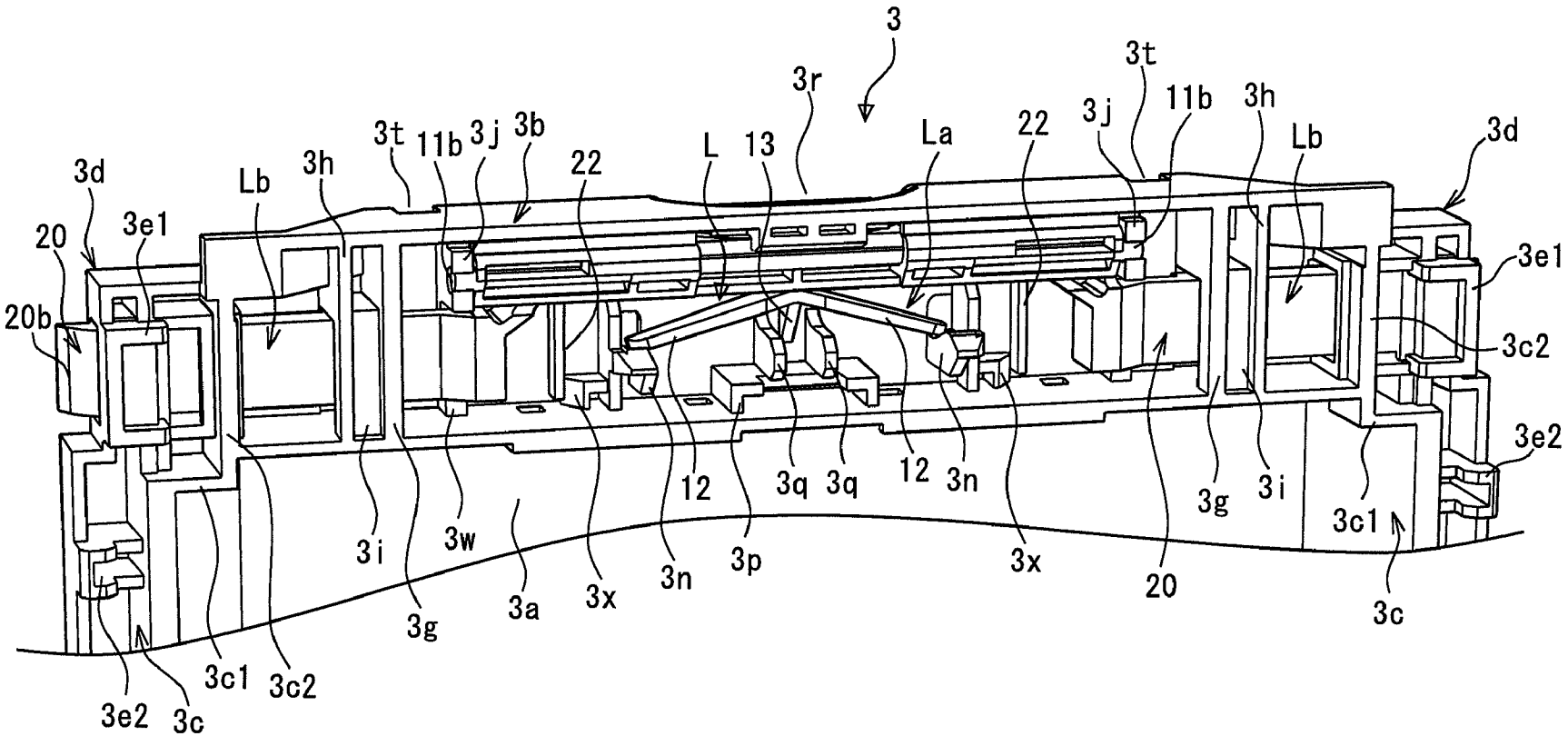
FIG. 15 is a partial perspective view showing that the lock member included in the folding container according to the present invention has been attached to the short side wall.
Figure 16:
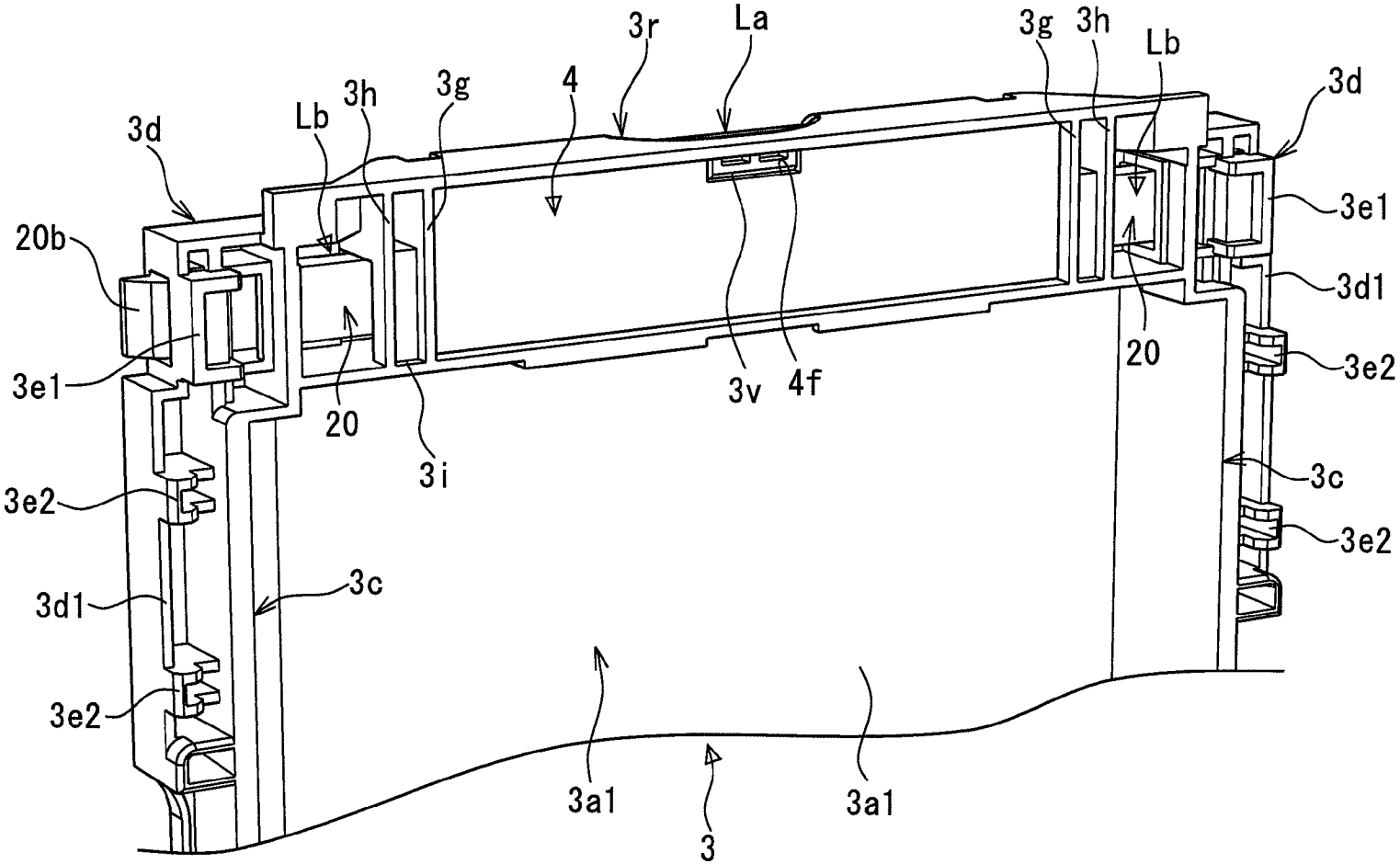
FIG. 16 is a partial perspective view showing that the cover member included in the folding container according to the present invention has been attached to the short side wall.
Figure 17:
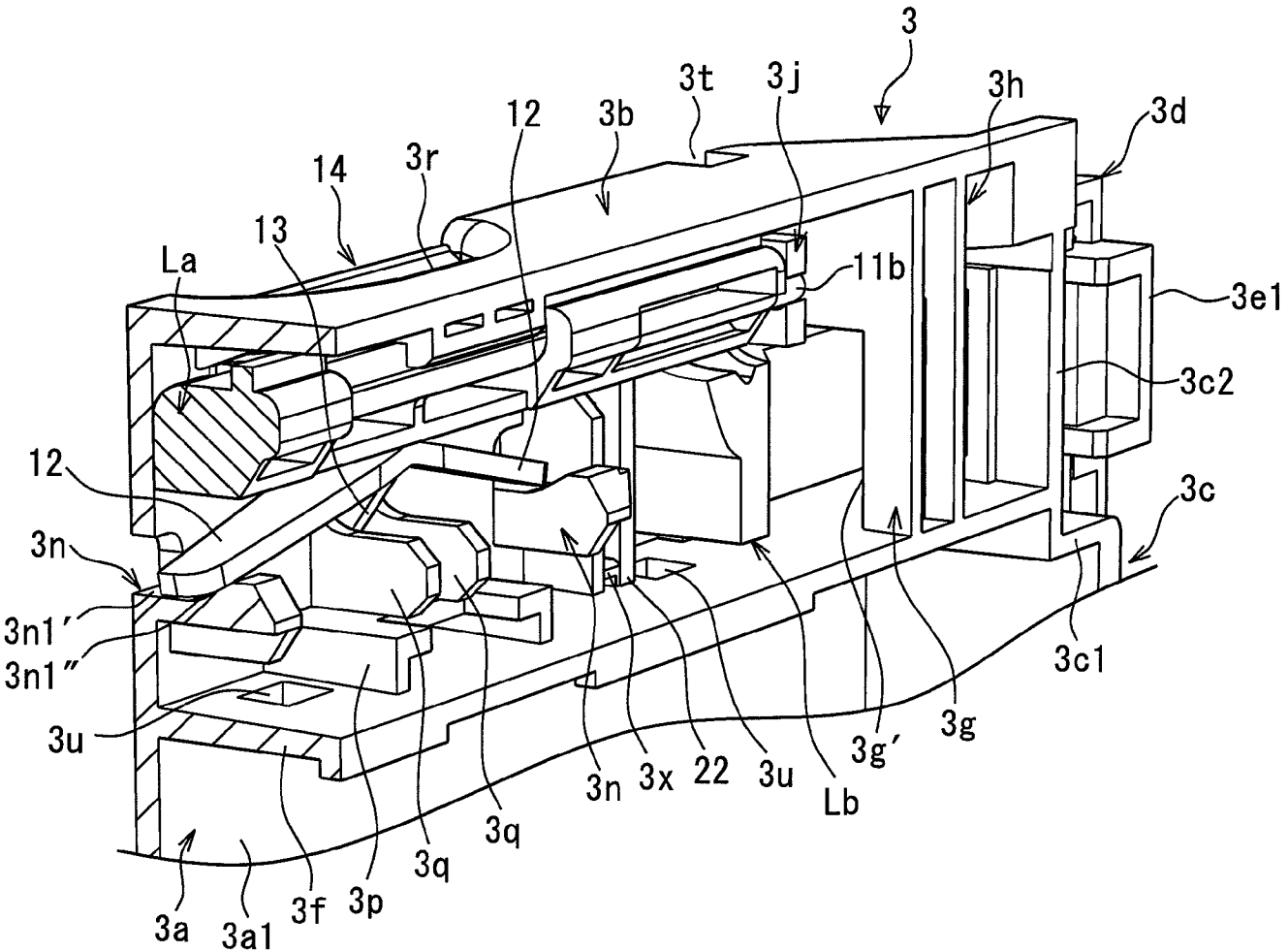
FIG. 17 is a partial perspective view showing the lock state of the folding container according to the present invention, the partial perspective view including a partial vertical cross section.

Then, the operation portion La is moved closer to the outer surface 3*a*1 of a part of the plate-like portion 3*a* of the short side wall 3 which is positioned in the central space portion A1 to fit the pivotal short shaft 11*b* formed on the leading vertical surface 11*a* of each of the horizontal arms 11 included in the operation portion La, into the fitting recess portion 3*j*1 of the corresponding pivotal short-shaft supporting block 3*j* formed on a part of the plate-like portion 3*a* which is positioned in the central space portion A1 of the short side wall 3 and close to the upper-end horizontal flange 3*b*, as shown in FIGS. 15 and 17. Furthermore, each of the driven short shafts 15 formed on the operation main body 10 is inserted into the cam hole portion 21*a* formed in the corresponding one of the cam plates 21 included in the lock bar Lb. Additionally, the operation portion 14 formed in the operation main body portion 10 is configured to be inserted into the operation portion insertion space portion A2 formed so as to stride over the central portion of the upper-end horizontal flange 3*b* and the plate-like portion 3*a*, both of which are included in the short side wall 3. Moreover, the tip portion 12*b* of each of the inclined spring members 12 formed in the central portion of the bottom surface of the operation main body 10 of the operation portion La is placed on the horizontal surface 3*n*1' forming the top surface 3*n*1 of the corresponding spring receiving and supporting block 3*n* formed in the central space portion A1 of the short side wall 3.

As described above, when the operation portion 14 formed in the operation main body portion 10 of the operation portion La included in the lock member L is inserted, as described above, into the operation portion insertion space portion A2 formed so as to stride over the central portion of the upper-end horizontal flange 3*b* and the plate-like portion 3*a*, both of which are included in the short side wall 3, the linear portion 14*c* of the operation portion 14 is substantially flush with the inner surface 3*a*2 of the short side wall 3. Furthermore, the inclined spring member protect piece 13 suspended from the bottom surface of the lower horizontal plate portion 10*b* of the operation main body 10 included in the operation portion La is placed between the paired reinforcing vertical pieces 3*q* formed in the central space portion A1 formed in the short side wall 3.

Figure 18:
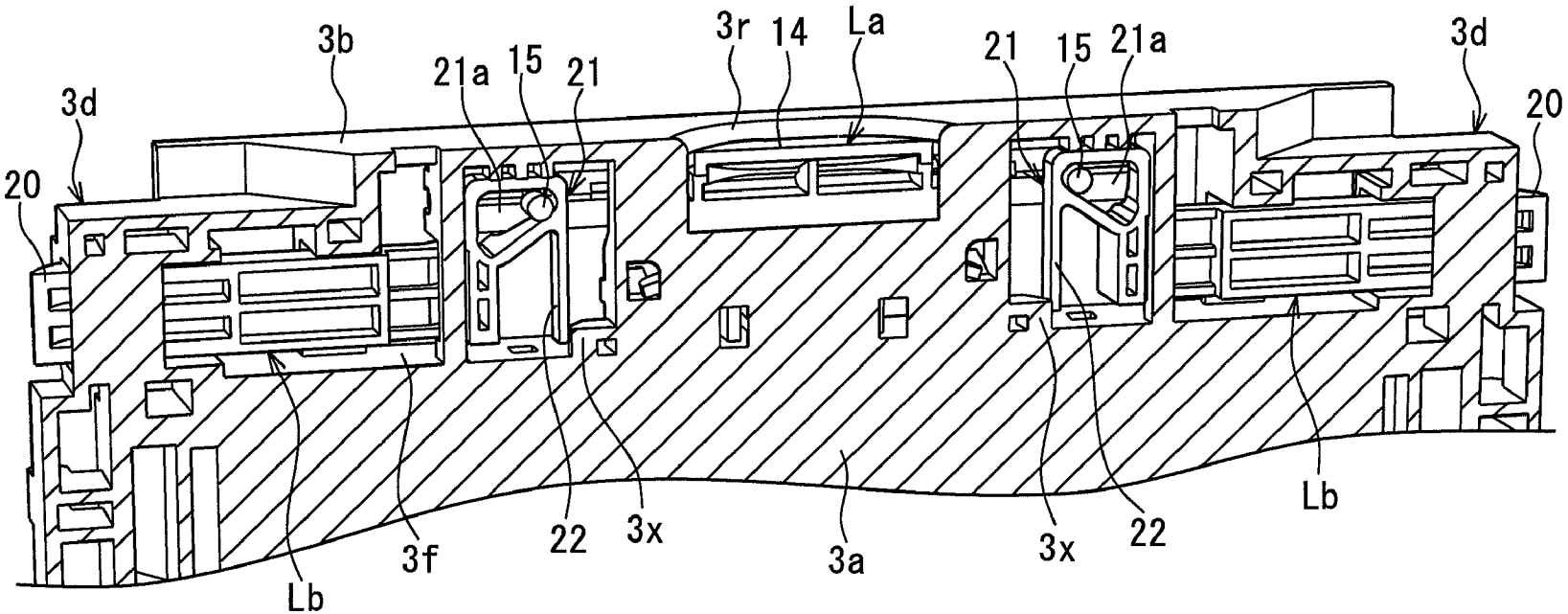
FIG. 18 is a partial perspective view showing the locked state of the folding container according to the present invention, the partial perspective view including a partial vertical cross section of the short side wall.

Furthermore, when the lock member L is attached to the short side wall 3, the tip portion of the plate-like member 20 of each of the lock bars Lb projects from the vertical end wall 3*d*1 included in the short side wall-side engaging member 3*d*. Moreover, the tip portion 12*b* of each of the inclined spring members 12 formed in the central portion of the bottom surface of the operation main body 10 of the operation portion La is placed on the horizontal surface 3*n*1' forming the top surface 3*n*1 of the corresponding spring receiving and supporting block 3*n* formed in the central space portion A1 of the short side wall 3. Moreover, when each of the driven short shafts 15 formed on the operation main body 10 of the operation portion La is inserted into the cam hole portion 21*a* drilled in the cam plate 21 included in the corresponding lock bar Lb, the driven short shaft 15 is positioned close to the upper corner 21*a*' formed by the top surface 21*a*1 forming the corresponding cam hole portion 21*a* and the upper end of the inclined surface 21*a*3 as shown in FIG. 18.

Moreover, when the lock member L is attached to the short side wall 3 as described above, the circular-arc operation portion 14 formed on the operation main body 10 of the lock member L is fitted into the operation portion insertion space portion A2 formed in the central portion of the inner upper corner of the short side wall 3 of the folding container assembled in box form.

Then, the main body portion 4*a* of the cover member 4 is placed opposite the outer surface 3*a*1 of a part of the plate-like portion 3*a* which is positioned in the central space portion A1 formed in the short side wall 3. Thereafter, the cover member 4 is moved closer to the short side wall 3. Then, the insertion piece 4*c* projected from the top surface 4*b*1 of each of the upper-end block portions 4*b* included in the cover member 4 is inserted into the cutout through-hole 3*t* formed close to the corresponding one of the opposite ends of the corner formed by the upper-end horizontal flange 3*b* and plate-like portion 3*a* of the short side wall 3. Furthermore, the triangular-prismatic vertical projecting portion 4*d* projected from the lower end of each of the opposite vertical side surfaces 4*a*1 of the main body portion 4*a* included in the cover member 4 is hooked on the inner edge 3*g*1 positioned closer to the lock bar insertion hole 3*g*' formed in corresponding one of the closer-to-center coupling vertical ribs 3*g* formed on the short side wall 3. Moreover, each of the triangular-prismatic horizontal projecting portions 4*e* suspended from the bottom surface of the main body portion 4*a* included in the cover member 4 is fitted into the corresponding one of the locking through-holes 3*u* formed in a part of the upper horizontal rib 3*f* which is positioned in the central space portion A1 of the short side wall 3. Furthermore, the engaging vertical piece 4*g* bridging the opposite side surfaces 4*f*1 of the recess portion 4*f* formed in the central portion of the top surface of the main body portion 4*a* included in the cover member 4 is locked on the elastic locking piece 3*v* suspended from the rear surface of the upper-end horizontal flange 3*b* of the short side wall 3. Thus, the central space portion A1 formed in the short side wall 3 is covered by the cover member 4.

In the covering step in which the cover member 4 is attached so as to cover the central space portion A1 formed in the above-described short side wall 3, the following inclined surfaces are arranged on the outer surface 3*a*1 side of the plate-like portion 3*a* forming the short side wall 3: the vertical inclined surface 4*d*2 formed on the triangular-prismatic vertical projecting portion 4*d* projected from the lower end of each of the opposite vertical side surfaces 4*a*1 of the main body portion 4*a* included in the cover member 4 and the horizontal inclined surface 4*e*2 of each of the triangular-prismatic horizontal projecting portions 4*e* suspended from the bottom surface of the main body portion 4*a*. In this state, when the cover member 4 is moved closer to the short side wall 3, the vertical inclined surface 4*d*2 formed on the triangular-prismatic vertical projecting portion 4*d* projected from the lower end of each of the opposite vertical side surfaces 4*a*1 of the main body portion 4*a* included in the cover member 4 comes into abutting contact with the corresponding one of the closer-to-center coupling vertical ribs 3*g* formed in the central space portion A1 formed in the short side wall 3. Hence, the triangular-prismatic vertical projecting portion 4*d* is guided via the vertical inclined surface 4*d*2. This facilitates installation of the cover member 4 over the central space portion A1. Similarly, the horizontal inclined surface 4*e*2 of each of the triangular-prismatic horizontal projecting portions 4*e* suspended from the bottom surface of the main body portion 4*a* included in the cover member 4 comes into abutting contact with the tip of the upper horizontal rib 3*f* of the short side wall 3. Hence, the triangular-prismatic horizontal projecting portion 4*e* is guided via the horizontal inclined surfaces 4*e*2. This facilitates installation of the cover member 4 over the central space portion A1. Thus, as shown in FIG. 16, the cover 4 covers the central space portion A1 formed in the short side wall 3.

As described above, the cover member 4 covers the central space portion A1 formed in the short side wall 3. This prevents external exposure of the operation portion La and lock bars Lb included in the lock member L located in the central space portion A1 formed over the outer surface 3*a*1 of the plate-like portion 3*a*1 of the short side wall 3. Thus, the operation portion La and lock bars Lb included in the lock member L located in the central space portion A1 can be prevented from being damaged by an external member. Furthermore, the cover member 4 allows the central space portion from being deformed by a load imposed from above when folding containers are stacked. As a result, the operation portion La and lock bars Lb included in the lock member L can be prevented from being damaged.

Figure 19:
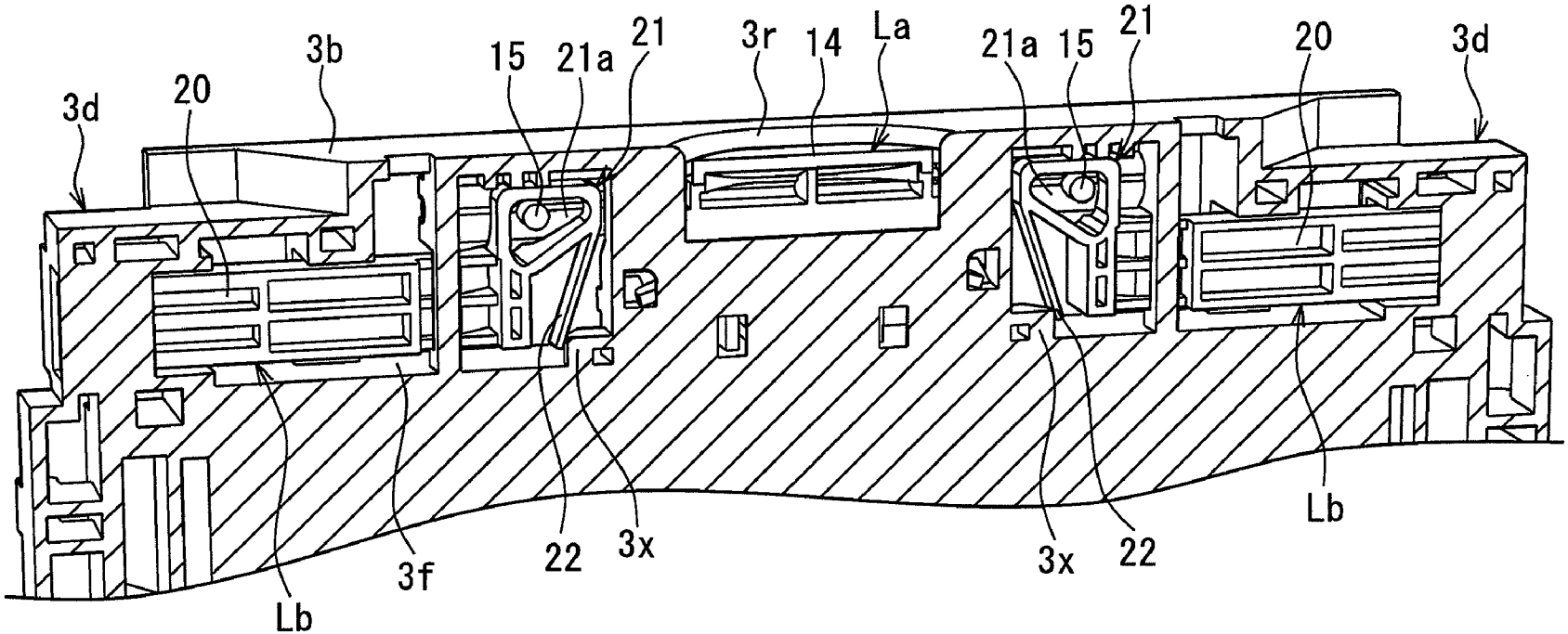
FIG. 19 is a partial perspective view showing the unlocked state of the folding container according to the present invention, the partial perspective view including a partial vertical cross section of the short side wall.

To assemble the folded folding container into box form as shown in FIG. 1, the operator first pivotally moves the long side walls 2 in a horizontal state in the vertical direction so that the long side walls 2 stand vertically. Then, the operator pivotally moves the short side walls 3 in a horizontal state in the vertical direction. However, during the step in which the short side walls 3 are pivotally moved in the vertical direction, the inclined surface 20*b* formed at the tip portion of the plate-like member 20 of each of the lock bars Lb included in the lock member L attached to each the short side wall 3 comes into abutting contact with the vertical side wall 2*d*1 included in the corresponding one of the engaging recess portions 2*d* formed in each of the long side walls 2. In this state, the operator further pivotally moves the short side wall 3 in the vertical direction. Then, each of the inclined surfaces 20*b* formed at the tip portion of the plate-like member 20 of the lock bar Lb is guided by the vertical side wall 2*d*1 of the corresponding one of the engaging recess portions 2*d* formed in the long side wall 2. At the same time, the paired lock bars Lb move closer to each other in the horizontal direction. Furthermore, the tip portion of each of the plate-like members 20 of the lock bar Lb is retracted from the corresponding one of the vertical side wall portions 3*d*2 included in the short side wall-side engaging member 3*d*. In this manner, when the paired lock bars Lb move closer to each other in the horizontal direction, the cam hole portion 21*a* of the cam plate 21 moves in the horizontal direction without coming into abutting contact with the driven short shaft 15 on the operation portion La. Furthermore, when the paired lock bars Lb move closer to each other in the horizontal direction, the tip of the vertical spring member 22 formed in each of the lock bar Lb is elastically deformed toward the corresponding one of the plate-like members 20 against the elastic force thereof as shown in FIG. 19.

Thereafter, the inclined surface 20*b* formed at the tip portion of the plate-like member 20 of each of the lock bars Lb passes over the vertical side wall 2*d*1 of the corresponding one of the engaging recess portions 2*d* formed in the long side wall 2. Then, the paired lock bars Lb move away from each other in the horizontal direction by the elastic recovery force of the vertical spring member 22 formed in each of the lock bars Lb. The tip portion of the plate-like member 20 of each of the lock bars Lb is then inserted into the corresponding one of the engaging recess portions 2*d* formed in the long side wall 2 as shown in FIG. 20.

Immediately before the tip portion of the plate-like member 20 of each of the lock bars Lb included in the lock member L attached to the above-described short side wall 3 is inserted into the corresponding one of the engaging recess portions 2*d* formed in the long side wall 2, the upper-end fitting projecting portion 3*e*1 formed on each of the short side wall-side engaging portion 3*d* of the short side wall 3 is fitted into the upper-end fitting hole 2*e*1 formed at the upper end of the corresponding one of the long side wall-side engaging members 2*c* of the long side wall 2. Furthermore, the fitting projecting portion 3*e*2 formed on each of the short side wall-side engaging portions 3*d* of the short side wall 3 is fitted into the fitting hole 2*e*2 formed in the corresponding one of the long side wall-side engaging members 2*c* of the long side wall 2.

As described above, simply by vertically raising the long side walls 2 in the horizontal state and then pivotally moving the short side walls 3 in the horizontal state in the vertical direction, the folded folding container can be assembled into box form as shown in FIG. 1 without the need for the operator's operation of the lock member L attached to each of the short side walls 3.

Figure 20:
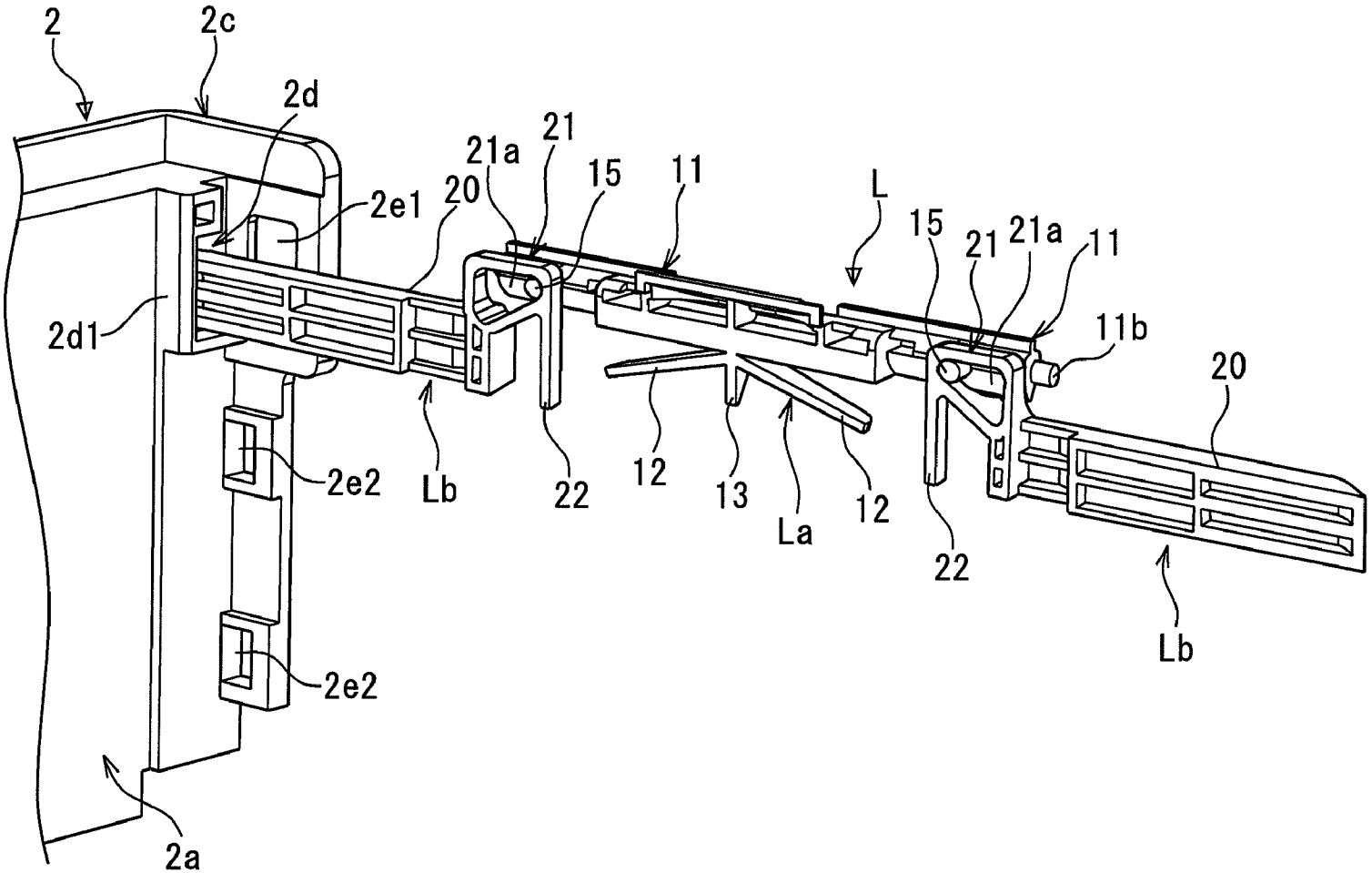
FIG. 20 is a partial perspective view showing the locked state of the folding container according to the present invention, with the short side wall omitted.

Furthermore, as described above, when the folding container is assembled into box form, the tip portion of the plate-like member 20 of each of the lock bars Lb included in the lock member L disposed on the short side wall 3 is inserted into the corresponding one of the engaging recess portions 2*d* formed in the long side wall 2 as shown in FIG. 20. This prevents the short side walls 3 from being inadvertently brought down toward the bottom portion 1.

Moreover, as described above, during the assembly of the folding container into box form, when the paired lock bars Lb move closer to each other in the horizontal direction, the cam hole portion 21*a* of the cam plate 21 included in each of the lock bars Lb moves in the horizontal direction without coming into abutting contact with the corresponding one of the driven short shafts 15 of the operation portion La. This prevents the operation portion La from moving pivotally. Hence, each of the lock bars Lb only elastically deforms the vertical spring member 22 formed therein. This in turn reduces a load imposed when the paired lock bars Lb are moved closer to each other in the horizontal direction. Consequently, the operation of assembling the folding container is facilitated.

When the folding container is in assembled box form, the tip portion 12*b* of each of the inclined spring members 12 formed in the central portion of the bottom surface of the operation main body 10 of the operation portion La is placed on the horizontal surface 3*n*1' forming the top surface 3*n*1 of the corresponding one of the spring receiving and supporting blocks 3*n* formed in the central space portion A1 of the short side wall 3 as shown in FIG. 17.

Figure 21:
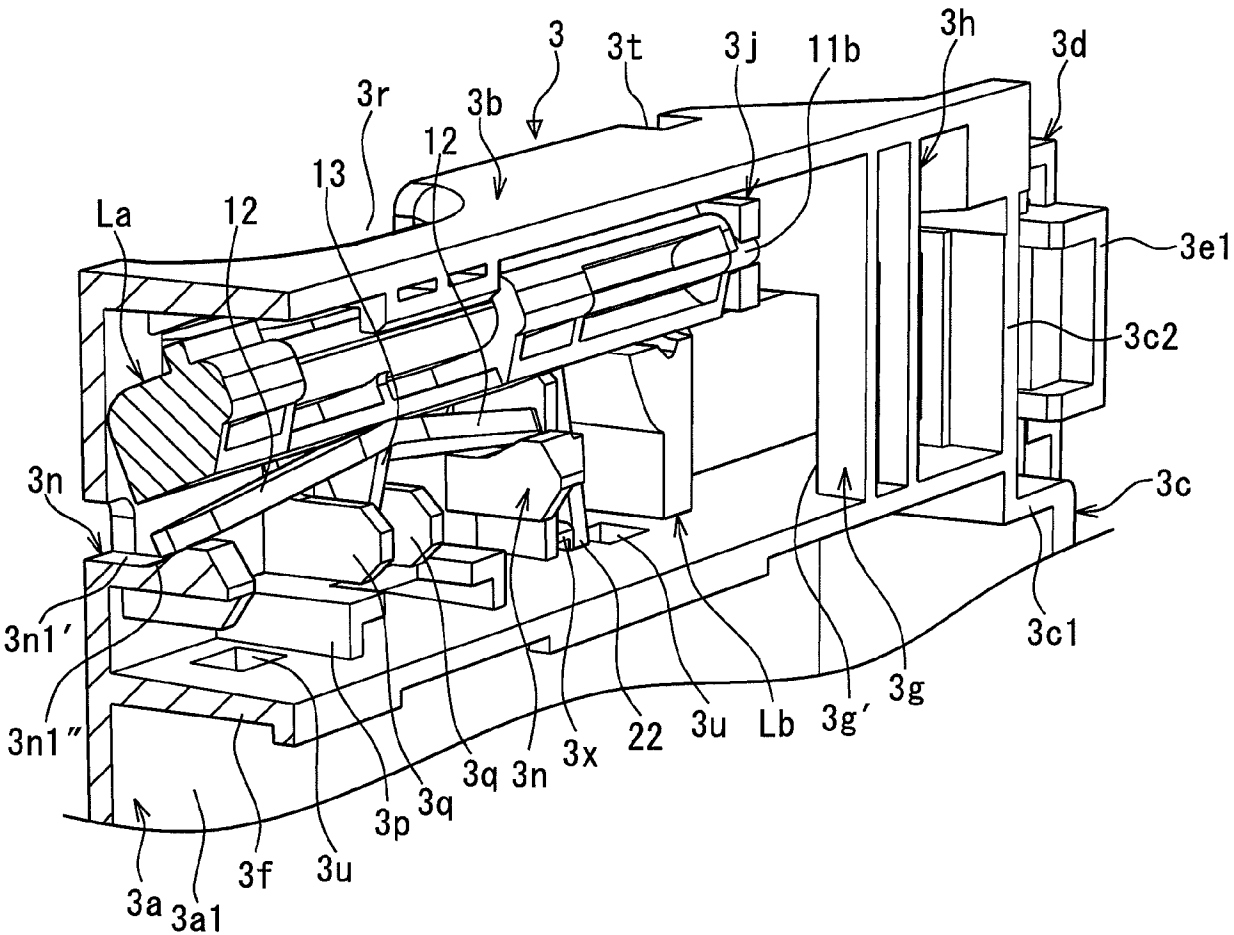
FIG. 21 is a perspective view showing the unlocked state of the folding container according to the present invention, the partial perspective view including a partial vertical cross section.
Figure 22:
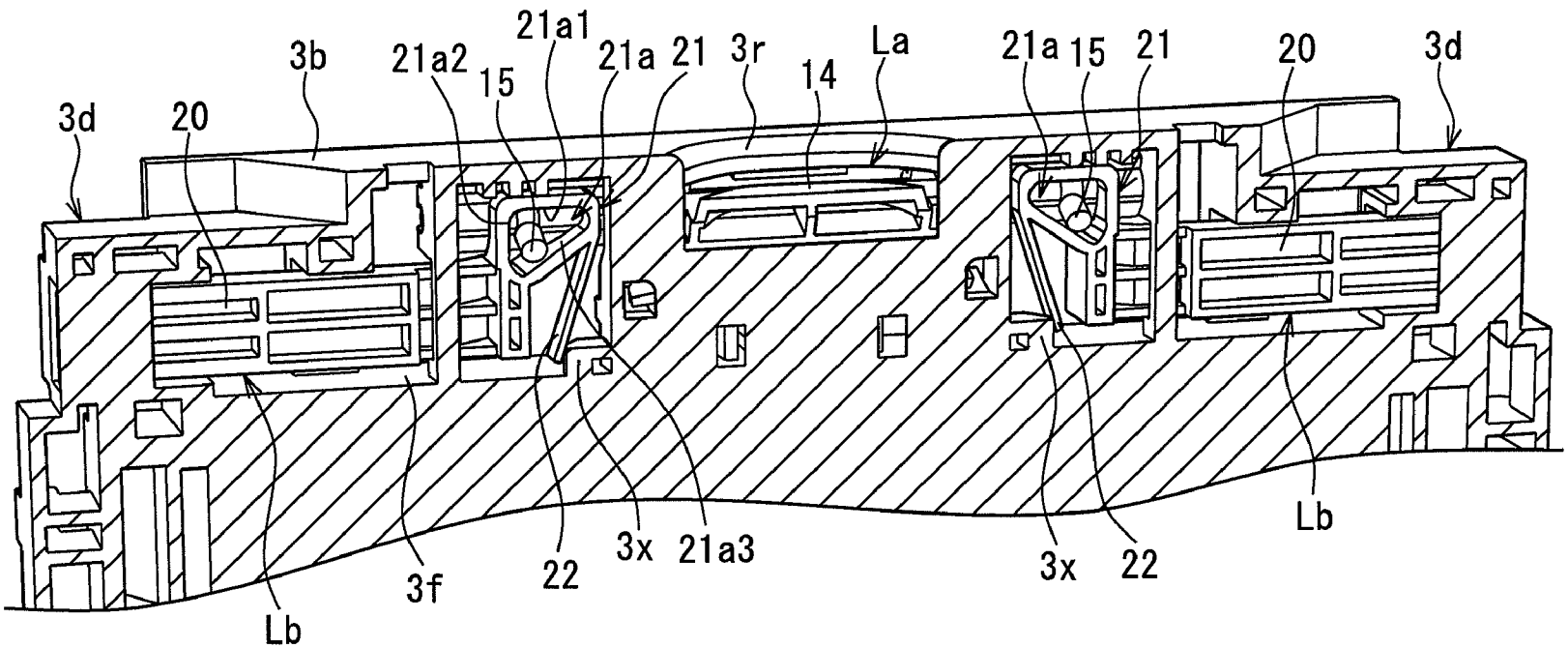
FIG. 22 is a partial perspective view showing the unlocked state of the folding container according to the present invention, the partial perspective view including a partial vertical cross section of the short side wall.

To fold the folding container assembled in box form, the operator first presses the finger on the top surface 14*a* of the circular-arc operation portion of the operation portion La included in the lock member L attached to the short side wall 3. The operator then pivotally moves the operation portion La inward downward in the folding container using, as pivotal-movement supporting points, the pivotal short shafts 11*b* of the operation portion La fitted in the fitting recess portions 3*j*1 of the pivotal short-shaft supporting blocks 3*j* formed on the part of the plate-like portion 3*a* which is positioned in the central space portion A1 of the short side wall 3. Then, as shown in FIG. 21, the tip portion 12*b* of each of the inclined spring members 12 formed on the operation main body 10 of the operation portion La comes into abutting contact with the horizontal surface 3*n*1 forming the top surface 3*n*1 of the corresponding one of the spring receiving and supporting blocks 3*n* formed on the short side wall 3, and then with the inclined surfaces 3*n*1". Thus, the inclined spring members 12 are elastically deformed against the elastic force thereof, in a direction in which the tip portions 12*b* of the inclined spring members 12 leave each other, in other words, in a direction in which the tip portion 12*b* of each of the inclined spring members 12 approaches the operation main body 10 of the operation portion La. The downward pivotal movement of the operation portion La allows the driven short shaft 15 of each of the lock bars Lb positioned close to the upper corner 21*a*' of the cam hole portion 21*a* formed in the cam plate 21 of the corresponding one of the lock bars Lb to move downward along the inclined surface 21*a*3 of the cam hole portion 21*a* as shown in FIG. 22. Thus, when each of the driven short shafts 15 moves downward along the inclined surface 21*a*3 of the corresponding one of the cam hole portions 21*a*, the paired lock bars Lb move closer to each other in the horizontal direction to allow the tip portion of the plate-like member 20 of each of the lock bars Lb to be discharged from the corresponding one of the engaging recess portions 2*d* formed in the long side wall 2. Hence, the short side wall 3 locked on the long side wall 2 via the lock member L is unlocked. Then, the short side walls 3 are brought down toward the bottom portion 1 and laid on top of the bottom portion 1 and on top of each other. Thereafter, the long side walls 2 are brought down toward the bottom portion and laid on top of the short side walls 3 stacked on the bottom portion 1 and on top of each other. In this manner, the folding container assembled in box form can be folded.

As described above, the operation portion La included in the lock member L is pivotally moved downward using, as pivotal-movement supporting points, the pivotal short shafts 11 of the operation portion La fitted in the fitting recess portions 3*j*1 of the pivotal short-shaft supporting blocks 3*j* formed on the part of the plate-like portion 3*a* which is positioned in the central space portion A1 of the short side wall 3. Thus, regardless of where on the top surface 14*a* of the operation portion 14 formed on the operation main body 10 included in the operation portion La, the operator's finger is located, the laterally paired lock bars Lb, disposed across the operation portion La, have the same horizontal travel distance. This enables reliable cancellation of the lock state in which the short side walls 3 and the long side walls 2 are locked via the lock member L.

Furthermore, as described above, during the assembly of the folding container into box form, when the paired lock bars Lb move closer to each other in the horizontal direction, the cam hole portion 21*a* of the cam plate 21 included in each of the lock bars Lb moves in the horizontal direction without coming into abutting contact with the corresponding one of the driven short shafts 15 of the operation portion La. This prevents the operation portion La from moving pivotally. Hence, each of the lock bars Lb only elastically deforms the vertical spring member 22 formed therein. This in turn reduces a load imposed when the paired lock bars Lb are moved closer to each other in the horizontal direction. Consequently, the operation of assembling the folding container is facilitated.

Moreover, the operation portion La and lock bars Lb included in the lock member L located in the central space portion A1 formed in the short side wall 3 are covered by the cover member 4. This prevents the operation portion La and lock bars Lb included in the lock member L located in the central space portion A1 from being exposed to the outside of the short side wall 3. Therefore, the operation portion La and lock bars Lb included in the lock member L located in the central space portion A1 can be prevented from being damaged by an external member.

Moreover, when carrying the folding container assembled in box form, the operator holds the hand on the bottom surface of the upper horizontal rib 3*f* of the short side wall 3 or places the hand in a handling recess portion or a through-hole formed in a part of plate-like portion 3*a* which is located below and close to the upper horizontal rib 3*f*. However, according to the present invention, the operation portion La of the lock member L operated by the operator is disposed in the operation portion insertion space portion A2 formed in the central portion of the inner upper corner of the short side wall 3 and is configured to move pivotally inward of the folding container. This reliably prevents the operator from inadvertently touching the operation portion La to pivotally move the operation portion downward.

A rounded-off portion 12*b*1 is preferably formed on a corner of the tip portion 12*b* of each of the inclined spring members 12 formed in the operation main body 10 of the operation portion La which corner is positioned closer to the inclined surface 3*n*1" of the corresponding one of the spring receiving and supporting blocks 3*n*. The formation of such a rounded-off portion 12*b*1 allows the inclined spring member 12 to move smoothly from the horizontal surface 3*n*1' to inclined surface 3*n*1" of the spring receiving and supporting block 3*n*. This also enables a reduction in the movement of the inclined spring member 12 toward the spring receiving and supporting vertical rib 3*m*.

In the above-described embodiment, the operation portion La is pivotally moved downward using, as pivotal-movement supporting points, the pivotal short shafts 11 of the operation portion La fitted in the fitting recess portions 3*j*1 of the pivotal short-shaft supporting blocks 3*j* formed on the plate-like portion 3*a* of the short side wall 3. However, as is well known and described in U.S. Pat. No. 6,290,081 and the like, the operation portion may be configured to be movable upward and downward.

I claim:

1. A folding container including a first pair of opposite side walls brought down first toward a bottom portion and a second pair of opposite side walls brought down toward the bottom portion after the first pair of opposite side walls has been brought down, the folding container being characterized in that the folding container comprises a lock member disposed on each of the side walls brought down first, the lock member comprising a pair of lock bars movable in a horizontal direction and one operation portion, an inclined spring member provided in the operation portion and including a tip portion placed in a spring receiving and supporting block formed on each of the side walls brought down first, a cam hole portion formed in each of the lock bars and into which a driven short shaft formed on the operation portion is inserted, and a spring member formed on each of the lock bars and configured to come into abutting contact with a spring member abutting block formed on each of the side walls brought down first, so that when the lock bars are moved in a direction in which the lock bars approach each other, the operation portion is prevented from being moved by movement of the lock bars in the direction in which the lock bars approach each other.

2. The folding container according to claim 1, characterized in that when the operation portion included in the lock member is pivotally moved inward downward in the folding container using, as a pivotal movement supporting point, a pivotal short shaft formed on the operation portion and fitted in a fitting recess portion of a pivotal short-shaft supporting block formed on each of the side walls brought down first, a lock state in which the side walls brought down first are locked on the side walls brought down second is cancelled.

3. The folding container according to claim 1 or claim 2, characterized in that a central space portion formed in each of the side walls brought down first is covered by a cover member.

* * * * *